US012017825B2

(12) United States Patent
Throup

(10) Patent No.: US 12,017,825 B2
(45) Date of Patent: Jun. 25, 2024

(54) DOUBLE-WALLED CONTAINER

(71) Applicant: Multi Packaging Solutions UK Limited, Nottinghamshire (GB)

(72) Inventor: Richard Throup, Nottinghamshire (GB)

(73) Assignee: Multi Packaging Solutions UK Limited (GB)

( * ) Notice: Subject to any disclaimer, the term of this patent is extended or adjusted under 35 U.S.C. 154(b) by 285 days.

(21) Appl. No.: 17/642,933

(22) PCT Filed: Sep. 11, 2020

(86) PCT No.: PCT/GB2020/052198
§ 371 (c)(1),
(2) Date: Mar. 14, 2022

(87) PCT Pub. No.: WO2021/048563
PCT Pub. Date: Mar. 18, 2021

(65) Prior Publication Data

US 2022/0363428 A1 Nov. 17, 2022

(30) Foreign Application Priority Data

Sep. 13, 2019 (GB) ..... 1913237

(51) Int. Cl.
*B65D 5/02* (2006.01)
*B65D 5/10* (2006.01)
(Continued)

(52) U.S. Cl.
CPC ..... *B65D 5/0281* (2013.01); *B65D 5/0254* (2013.01); *B65D 5/103* (2013.01); *B65D 5/443* (2013.01); *B65D 5/5016* (2013.01)

(58) Field of Classification Search
CPC .. B65D 5/5016; B65D 5/0281; B65D 5/0227; B65D 5/0254; B65D 5/103; B65D 5/4266; B65D 5/443; B65D 5/5014
(Continued)

(56) References Cited

U.S. PATENT DOCUMENTS 2,513,902 A * 7/1950 Tyrseck ..... B65D 5/58 206/521
4,083,454 A * 4/1978 O'Neill ..... B65D 5/542 229/240

(Continued)

*Primary Examiner* — Christopher R Demeree
(74) *Attorney, Agent, or Firm* — Brian J. Goldberg; Rohini K. Garg

(57) ABSTRACT

A single piece container made of cardboard, paperboard or other flexible sheet material which provides improved strength properties, but without the need to laminate layers of sheet material together by having an outer shell comprising sidewall panels (3, 5, 7, 9) and a set of inner sidewall panels (11, 13, 15, 17) connected to the outer shell at foldlines. The set of inner sidewall panels includes a first inner sidewall panel in facing relationship with the inner surface of a first outer shell sidewall panel and integrally connected to one of the outer shell sidewall panels along a foldline, and a first set of further inner sidewall panels integrally connected to the first inner sidewall panel along a foldline, the sidewall panels of the set of further inner sidewall panels being hingedly connected to one another about respective foldlines. The set of inner sidewall panels also includes a second set of further inner sidewall panels integrally connected to the first inner sidewall panel along a foldline, the sidewall panels of the second set of further inner sidewall panels being hingedly connected to one another about respective foldlines.

20 Claims, 9 Drawing Sheets

(51) Int. Cl.
*B65D 5/44* (2006.01)
*B65D 5/50* (2006.01)

(58) Field of Classification Search
USPC ..... 229/122.32, 185.1, 125.125, 120.12, 229/120.18, 167; 206/521, 45.25, 45.29; 493/89
See application file for complete search history.

(56) References Cited

U.S. PATENT DOCUMENTS

| | | | | | |
|---|---|---|---|---|---|
| 4,541,560 | A * | 9/1985 | Fischer | B65D 5/48004 | 229/120.29 |
| 5,524,815 | A * | 6/1996 | Sheffer | B65D 5/52 | 229/185 |
| 6,047,884 | A * | 4/2000 | Smith | B65D 5/48008 | 229/168 |
| 8,092,360 | B2 * | 1/2012 | Greenfield | B65D 5/0281 | 493/93 |
| 8,899,473 | B2 * | 12/2014 | Tibbels | B65D 5/48014 | 229/120.08 |
| 9,260,215 | B2 * | 2/2016 | Coltri-Johnson | B65D 5/566 | |
| 10,322,844 | B2 * | 6/2019 | Boersma | B31B 50/81 | |
| 2020/0385164 | A1 * | 12/2020 | Davis | B65D 5/0236 | |

* cited by examiner

DOUBLE-WALLED CONTAINER

TECHNICAL FIELD

The present invention relates to containers made of cardboard, paperboard or other lightweight foldable sheet materials.

BACKGROUND

Containers made of cardboard, paperboard or other foldable sheet material may be made from a sheet material formed by laminating multiple layers of sheet material together.

A laminate construction may result in a container having greater strength, and able to hold heavier products. However, the need to laminate sheets of material together complicates the manufacture process for the container, and may add additional cost.

The Applicant has realised that there is a need for a container made of cardboard, paperboard or other flexible sheet material which may provide improved strength properties, but without the need to laminate layers of sheet material together.

SUMMARY

From a first aspect, the present invention provides a single piece container made from cardboard, paperboard or other lightweight foldable sheet material, the container comprising:

an outer shell having a first end and a second end, and comprising a plurality of sidewall panels hingedly connected to one other about respective outer shell sidewall foldlines, the sidewall panels extending between the first end and the second end of the outer shell, the sidewall panels comprising first, second, third and fourth outer shell sidewall panels, wherein the first and second outer shell sidewall panels and the third and fourth outer shell sidewall panels form respective opposed pairs of outer shell sidewall panels, and wherein at least the second end of the outer shell is a closed end;

a first inner sidewall panel in facing relationship with the inner surface of the first outer shell sidewall panel, the first inner sidewall panel being integrally connected to one of the outer shell sidewall panels along a foldline;

and a first set of further inner sidewall panels integrally connected to the first inner sidewall panel along a foldline, the sidewall panels of the set of further inner sidewall panels being hingedly connected to one another about respective foldlines;

the first set of further inner sidewall panels comprising;

a second inner sidewall panel in facing relationship with the inner surface of the second outer shell sidewall panel, and third and fourth opposed inner sidewall panels extending between the first and second inner sidewall panels, the third inner sidewall panel being located on the same side of the container as the third outer shell sidewall panel and being located inwardly of and spaced from the inner surface of the third outer shell sidewall panel, and the fourth inner sidewall panel being located on the same side of the container as the fourth outer shell sidewall panel and being located inwardly of and spaced from the inner surface of the fourth outer shell sidewall panel;

the container further comprising a second set of further inner sidewall panels integrally connected to the first inner sidewall panel along a foldline, the sidewall panels of the second set of further inner sidewall panels being hingedly connected to one another about respective foldlines, the second set of further inner sidewall panels being located between the first set of further inner sidewall panels and one of the ends of the container, the second set of further inner sidewall panels comprising;

a fifth inner sidewall panel in facing relationship with the inner surface of the second outer shell sidewall panel, a sixth inner sidewall panel in facing relationship with the inner surface of the third outer shell sidewall panel, wherein the sixth inner sidewall panel is located closer to the third outer shell sidewall panel than the third inner shell sidewall panel, and a seventh inner sidewall panel in facing relationship with the inner surface of the fourth outer shell sidewall panel, wherein the seventh inner sidewall panel is located closer to the fourth outer shell sidewall panel than the fourth inner sidewall panel.

Thus, in accordance with the invention, a single piece container having an outer shell and a set of inner sidewall panels is provided. The container is erectable from a single piece blank. The inner sidewall panels include a first inner sidewall panel and a first set of further sidewall panels. A pair of opposed ones of the inner sidewall panels, the third and fourth inner sidewall panels, are spaced from the inner surfaces of respective ones of the outer shell sidewall panels on their sides of the container. In this way, the first inner sidewall panel and the first set of further sidewall panels provide an inner liner for the outer shell which reduces the size of internal space defined within a portion of the outer shell. The inner liner may more closely correspond to the outer contour of a product located in the container in use to better support the product.

The container also includes a second set of further inner sidewall panels located between the first set of further inner sidewall panels and one of the ends of the container. The sidewall panels of the second set of further sidewall panels are each located in facing relationship with inner surfaces of respective ones of the outer shell sidewall panels. The sixth and seventh inner sidewall panels are located respectively closer to the third and fourth outer shell sidewall panels than are the third and fourth inner sidewall panels. Thus the first inner sidewall panel and the additional set of further sidewall panels act to reinforce the outer shell providing a two-ply wall thickness.

It has been recognised that it may not be necessary for an internal fitment for reducing the internal dimension of the outer shell, as provided by the first set of further inner sidewall panels in association with the first inner sidewall panel, to extend over the entire height of the container. For example, support may only be required to be provided for a lower portion of a product e.g. bottle located in the container. The material of the blank which would otherwise provide a redundant region of the inner fitment may instead be used to reinforce the sidewalls of the outer shell e.g. in the upper portion of the container. In this way, the functions of providing an internal fitment reducing the internal dimension of the outer shell, and reinforcing the outer shell, may be simultaneously fulfilled, in embodiments, through simple modification of a blank for providing a fuller height internal fitment, and without wastage of material. The first and second further sets of inner sidewall panels may be provided within the footprint of a single set of inner sidewall panels for providing a fuller height internal fitment.

The first and second inner sidewall panels are located closer to the first and second outer shell sidewall panels respectively than the third and fourth inner sidewall panels are located relative to the third and fourth outer shell sidewall panels respectively. The spacing between the first inner sidewall panel and the first outer shell sidewall panel is less than both the spacing between the third inner sidewall panel and the third outer shell sidewall panel and the spacing between the fourth inner sidewall panel and the fourth outer shell sidewall panel. The spacing between the second inner sidewall panel and the second outer shell sidewall panel is less than both the spacing between the third inner sidewall panel and the third outer shell sidewall panel and the spacing between the fourth inner sidewall panel and the fourth outer shell sidewall panel. The third and fourth inner sidewall panels may be located at the same spacing from their respective outer shell sidewall panels.

The second inner sidewall panel is located at least as close to the second outer shell sidewall panel as is the fifth inner sidewall panel.

The first inner sidewall panel may be located at the same proximity to the first outer shell sidewall panel over its entire area.

The first inner sidewall panel is preferably in face-to-face contact with the inner surface of the first outer shell sidewall panel.

The second inner sidewall panel is preferably in face-to-face contact with the inner surface of the second outer shell sidewall panel.

The sixth and seventh inner sidewall panels are each located closer to the outer shell sidewall panel with which they are associated than are the third and fourth inner sidewall panels respectively.

The fifth inner sidewall panel is preferably in face-to-face contact with the inner surface of the second outer shell sidewall panel.

The sixth inner sidewall panel is preferably in face-to-face contact with the inner surface of the third outer shell sidewall panel.

The seventh inner sidewall panel is preferably in face-to-face contact with the inner surface of the fourth outer shell sidewall panel.

However, it is envisaged that in some embodiments, one or more of the second set of further inner sidewall panels need not necessarily be in face-to-face contact with the inner surface of the respective outer shell sidewall panel, although preferably at least one, and optionally both other ones of the second set of further inner sidewall panels is then in face-to-face contact with the inner surface of the respective outer shell sidewall panel.

The second set of further inner sidewall panels is located between the first set of further inner sidewall panels and one of the ends of the container. In embodiments, the second set of further inner sidewall panels are located between the first set of further inner sidewall panels and the first end of the container. The second end of the container is a closed end. The second end preferably provides a base for the container. This may enable the first set of further inner sidewall panels to cooperate with the first inner sidewall panel to provide an internal fitment reducing the interior space defined by the outer shell in a region closer to the base of the container, and the second set of further inner sidewall panels to cooperate with the first inner sidewall panel to provide reinforcement to the sidewalls of the outer shell in an upper portion of the outer shell.

The first and second sets of further inner sidewall panels may be located one above the other in the container.

The terms base, upper, lower, above, below etc. are not intended to confer any limitation in relation to the orientation of the container in use, but are used merely to facilitate understanding of the position of features relative to one another. However, typically the base may define a lower end of the container for supporting a product located in the container in use.

The relative heights of the panels of the first and second sets of further inner sidewall panels may be selected as desired. The heights of the panels within each set may vary. In some embodiments at least some, and preferably each one of the panels of the first set of further inner sidewall panels has a height that is greater than at least some, and preferably each one of the sidewall panels of the second set of further inner sidewall panels. For example, each one of the first set of further inner sidewall panels may have a height that is at least 1.5 times, or optionally at least twice the height of each one of the second set of further inner sidewall panels. This may result in the internal fitment provided by the first set of further inner sidewall panels extending over a greater height within the container than the reinforcement provided by the second set of further inner sidewall panels. The relative extent of the first and second sets of further inner sidewall panels in the direction of the height of the container i.e. between the first and second ends thereof, may be selected as desired, depending upon the balance between reinforcement and product support required for a particular product. This may depend upon e.g. the weight and dimensions of the product.

The relative dimensions of the first and second sets of further inner sidewall panels will depend upon the configuration of a product with which the container is intended to be used. In some embodiments each one of the sidewall panels of the second set of further inner sidewall panels is of the same height. In some embodiments the heights of the sidewall panels within the first set of further sidewall panels vary. The height refers to the maximum dimension of a panel along the direction connecting the first and second ends of the container.

The shape of the panels of the first and second sets of further inner sidewall panels may be selected as desired. The most appropriate shape of the first and second sets of further inner sidewall panels will depend upon the configuration of a product with which the container is intended to be used. In some embodiments, each of the end edges of each one of the second set of further inner sidewall panels may be straight. For example, the panels may each be of a square or rectangular shape. The end edges of the panels refer to those edges closest to the first and second ends of the outer shell respectively. The dimension of the panels along the direction in which these edges extend may define a width of the panel.

The first and second sets of further inner sidewall panels are preferably located directly adjacent one another along the direction extending between the first and second ends of the outer shell. This direction may correspond to the direction of the height of the container.

Edges of the second inner sidewall panel and the fifth inner sidewall panel (i.e. those edges furthest from the ends of the container) preferably abut one another. This may be the result of providing first and second sets of further inner sidewall panels separated by a cutline in the blank from which the container is erected. As discussed below, the first and second sets of further inner sidewall panels are advantageously provided in this manner by using a cutline to divide panels of the blank into pairs of panels, one panel from each pair providing a panel of the first set of further inner sidewall panels and the other providing a panel of the second set of inner sidewall panels. This may provide the two sets of panels without wastage of material.

The second set of further inner sidewall panels is located between the first set of further inner sidewall panels and one of the ends of the outer shell e.g. the first end of the outer shell. Preferably an edge of second inner sidewall panel closest to the fifth inner sidewall panel is located closer to said one of the ends of the outer shell (e.g. the first end) than the other end (e.g. the second end). In embodiments the edge of the second inner sidewall panel is located at least 60%, or at least 65% of the distance between the ends of the outer shell toward the end of the outer shell (e.g. the first end of the outer shell) from the opposite end thereof (e.g. the second end of the outer shell). This may result in the support function being provided over a greater extent of the height of the outer shell than the reinforcement function.

In embodiments the container is erected from a single piece blank in which adjacent ends of the panels of the first and second sets of further inner sidewall panels are separated by a cutline. The adjacent ends of the sidewall panels are the ends of the respective sidewall panels furthest from the ends of the outer shell i.e. the first and second ends thereof. The adjacent ends are thus the ends disposed toward the interior of the outer shell.

In general, the adjacent ends of the panels of the first and second sets of further inner sidewall panels are separated by a cutline.

The edges of the fourth and seventh, and third and sixth inner sidewall panels furthest from the ends of the outer shell are preferably located directly adjacent one another along the direction extending between the first and second ends of the outer shell (i.e. along the height of the outer shell), with the edge of the fourth inner sidewall panel being located inboard of the edge of the seventh inner sidewall panel, and the edge of the third inner sidewall panel being located inboard of the edge of the sixth inner sidewall panel. This again may be the result of providing first and second sets of further inner sidewall panels separated by a cutline in the blank from which the container is erected.

The first inner sidewall panel preferably extends over substantially the entire height of the first outer shell sidewall panel. Portions of the first inner sidewall panel closer to the first and second ends of the outer shell respectively cooperate with respectively ones of the first and second sets of further inner sidewall panels. Preferably the portion of the first inner sidewall closer to the first end of the outer shell cooperates with the second set of further inner sidewall panels.

Each one of the first set of further inner sidewall panels and each one of the second set of further inner sidewall panels extends over only a portion of the height of the outer shell sidewall panel with which it is associated (i.e. with which it is in facing relationship with).

The outer shell sidewall panels are preferably continuous walls. This will enable the sidewalls of the outer shell to fully surround a product located therein.

The first inner sidewall panel is integrally connected to one of the outer shell sidewall panels along a foldline. The first inner sidewall panel may be integrally connected to the third outer shell sidewall panel along the foldline. The third outer shell sidewall panel may be adjacent the first outer shell sidewall panel.

The first and second sets of further inner sidewall panels are integrally connected to the first inner sidewall panel along further foldlines. The first inner sidewall panel may be integrally connected on one side thereof to one of the outer shell sidewall panels (e.g. the third outer shell sidewall panel) along a foldline, with the first and second sets of further inner sidewall panels being integrally connected to the first inner sidewall on an opposite side thereof. The foldlines connecting the first and second sets of further inner sidewall panels to the first inner sidewall panel are different foldlines. They are different to the foldline connecting the first inner sidewall panel to one of the outer shell sidewall panels.

In embodiments the fourth inner sidewall panel may be connected to the first inner sidewall panel along a foldline. In the first set of further inner sidewall panels, the third inner sidewall panel may be connected along a foldline to the second inner sidewall panel, and the second inner sidewall panel may be connected along a foldline to the fourth inner sidewall panel.

The second set of further inner sidewall panels is integrally connected to the first inner sidewall panel along a foldline. In embodiments the seventh inner sidewall panel may be connected to the first inner sidewall panel along a foldline. In the second set of further inner sidewall panels, the fifth inner sidewall panel may be connected along a foldline to the seventh inner sidewall panel, and the sixth inner sidewall panel may be connected along a foldline to the fifth inner sidewall panel.

In embodiments the fourth and seventh inner sidewall panels are connected to the first inner sidewall panel along respective foldlines.

The foldlines connecting the first and second sets of further inner sidewall panels to the first inner sidewall panel are different foldlines.

The foldline connecting the first set of further inner sidewall panels to the first inner sidewall panel may be offset from the foldline connecting the second set of further inner sidewall panels to the first inner sidewall panel. The foldline connecting the first set of further inner sidewall panels to the first inner sidewall panel lies inboard of the foldline connecting the second set of further inner sidewall panels to the first inner sidewall panel. In embodiments the foldline connecting the first set of further inner sidewall panels to the first inner sidewall panel is offset from e.g. lies inboard of the foldline connecting the second set of further inner sidewall panels to the first inner sidewall panel by at least 5%, and optionally up to 15%, or up to 10% of the width of the first inner shell sidewall panel. The foldline connecting the first set of further inner sidewall panels to the first inner sidewall panel may lie inboard of the foldline connecting the second set of further inner sidewall panels to the first inner sidewall panel in the direction along a width of the first outer shell sidewall panel. The foldline connecting the first set of further inner sidewall panels to the first inner sidewall panel may lie closer to a longitudinal central axis of the first inner sidewall panel than the foldline connecting the second set of further inner sidewall panels to the first inner sidewall panel.

The foldlines connecting the first and second sets of further inner sidewall panels to the first inner sidewall panel may extend to the ends of the first inner sidewall panel to or to a point spaced therefrom. Preferably each foldline extends to a point within a distance corresponding to less than 10%, or less than 5% of a height of the first inner sidewall panel from a respective end thereof. The extent of the offset will depend e.g. upon the dimensions of the internal fitment to be provided by the first set of further inner sidewall panels.

The spacing of the third and fourth inner sidewall panels from the inner surfaces of the third and fourth outer shell sidewall panels respectively may be selected as desired, depending upon the dimensions of the product to be supported by the first set of further inner sidewall panels. In embodiments the third inner sidewall panel is spaced from the inner surface of the third outer shell sidewall panel by a distance corresponding to at least 5%, and optionally up to 15%, or up to 10% of the width of the third outer shell sidewall panel, and the fourth inner sidewall panel is spaced from the inner surface of the fourth outer shell sidewall panel by a distance corresponding to at least 5%, and optionally up to 15%, or up to 10% of the width of the fourth outer shell sidewall panel.

The fourth inner sidewall panel lies inboard of the seventh inner sidewall panel, and the third inner sidewall panel lies inboard of the sixth inner sidewall panel.

In embodiments the foldline connecting the second and fourth inner sidewall panels is offset from (i.e. inboard of) the foldline connecting the fifth and seventh inner sidewall panels. The foldline connecting the second and fourth inner sidewall panels may be located inboard of the foldline connecting the fifth and seventh inner sidewall panels along the direction of the width of the second outer shell sidewall panel. The foldline connecting the second and third inner sidewall panels is offset from (i.e. located inboard of) the foldline connecting the fifth and sixth inner sidewall panels. The foldline connecting the second and third inner sidewall panels may be located inboard of the foldline connecting the fifth and sixth inner sidewall panels along the direction of the width of the second outer shell sidewall panel. This arrangement may result from the relative positions of the sixth and seventh and third and fourth inner sidewall panels.

In embodiments the foldline connecting the second and third inner sidewall panels is offset from (i.e. inboard of) the foldline connecting the second and third outer shell sidewall panels. The foldline connecting the second and third inner sidewall panels may be inboard of the foldline connecting the second and third inner sidewall panels along a direction of the width of the second outer shell sidewall panel.

The foldline connecting the second and fourth inner sidewall panels is offset from (i.e. inboard of) the foldline connecting the second and fourth outer shell sidewall panels. The foldline connecting the second and fourth inner sidewall panels may be inboard of the foldline connecting the second and fourth inner sidewall panels along a direction of a width of the second outer shell sidewall panel.

The foldline connecting the first and fourth inner sidewall panels may be offset from (i.e. inboard of) the foldline connecting the first and fourth outer shell sidewall panels. The foldline connecting the first and fourth inner sidewall panels may be inboard of the foldline connecting the first and fourth outer shell sidewall panels along a direction of a width of the first outer shell sidewall panel.

The foldline connecting the first and third inner sidewall panels may be offset from (i.e. inboard of) the foldline connecting the first inner shell sidewall panel and the third outer shell sidewall panel. The foldline connecting the first and third inner sidewall panels may be inboard of the foldline connecting the first and third outer shell sidewall panels along a direction of a width of the first inner sidewall panel.

By inboard herein it is meant that the specified foldline or inner sidewall panel is offset from the other foldline or inner sidewall panel in a direction toward an interior of the container. The direction to toward the interior of the container may be a direction into the interior space of the container or closer to a centreline of one of the sidewall panels as the context demands. The direction may be a direction parallel to the directions along which the first and second outer shell sidewall panels extend.

In embodiments, a set of one or more cutlines is provided extending along at least some, and optionally each one of the foldlines connecting ones of the inner sidewall panels within the first and second sets of further inner sidewall panels. This may help to ensure that folding reliably occurs along the foldlines when erecting the blank, since the foldlines between adjacent ones of the inner sidewall panels (along the direction between the first and second ends of the container) from the first and second sets of further inner sidewall panels are offset from one another. Alternatively or additionally in embodiments a slot is defined extending along at least one of the foldlines. Preferably such a slot is provided along at least one of the foldlines connecting ones of the inner sidewall panels within the second further set of sidewall panels (e.g. at least a foldline connecting the fifth and sixth inner sidewall panels). This may help to avoid bunching of material around the foldline which may otherwise occur. The need for cutlines or slots as described will depend upon factors such as the basis weight of the sheet material. Alternatively or additionally a set of one or more cutlines is provided extending along the foldlines connecting the first and second sets of further inner sidewall panels to the first inner sidewall panel. This may similarly help to ensure reliable folding along the foldlines, since these foldlines will also be offset from one another.

The container has first and second ends, which may be defined by the first and second ends of the outer shell.

The outer shell may comprise any suitable number of sidewall panels, depending upon the desired shape and configuration of the container. In some embodiments the outer shell has four sidewall panels, although a greater or lesser number of sidewall panels may be used. The first and second ends of the outer shell may provide the first and second ends of the container. The second end of the outer shell is a closed end, and may provide a base of the outer shell. The second end of the outer shell may provide a base of the container.

The first inner sidewall panel and the first set of further inner sidewall panels, and the second set of inner sidewall panels may be considered to provide an inner shell for the container. The inner shell may be considered to have first and second portions closer and further from one of the ends of the outer shell, defined by the first inner sidewall panel and the first set of further sidewall panels, and the first inner sidewall panel and the second set of further inner sidewall panels respectively. The inner shell preferably has one side for each one of the sidewall panels of the outer shell. Thus, the inner shell and outer shell preferably have the same number of sides. A given side of the inner shell may comprise a single panel e.g. the first inner sidewall panel, or multiple panels i.e. provided by ones of the first and second further sets of inner sidewall panels.

Each set of further inner sidewall panels may be a set of three inner sidewall panels. Thus, in embodiments, the second, third and fourth inner sidewall panels and the fifth, sixth and seventh inner sidewall panels are the only sidewall panels of the respective sets of further inner sidewall panels.

The sidewall panels within each one of the first and second sets of further inner sidewall panels may be of the same or differing size and shape. For example, the sets of further inner sidewall panels may include panels of differing widths and/or heights. The height of a panel as used herein refers to the dimension of the panel in the direction along the direction extending between the first and second ends of the outer shell. This may correspond to the direction extending between the first and second ends of the inner shell provided by the inner sidewall panels. The most appropriate shape and size of the sidewall panels of the shell may depend upon the configuration of a product to be located in the shell.

The container may be a square or rectangular container, although other configurations may be envisaged e.g. hexagonal, octagonal etc. The shape of the container will be defined by the shape of the outer shell, which may therefore be of any such shapes. In some embodiments the sidewall panels of the outer shell are rectilinear e.g. square or rectangular. It is not necessary that the inner sidewall panels are rectilinear. For example, one or both ends of at least some of the panels may be curved, or have a shape to help support a product located in the container. For example, where the first set of further inner shell sidewall panels is located closer to the second end of the outer shell, the ends of at least some of the first set of further inner shell panels closer to the second end of the outer shell may be shaped to help support the base of a product as appropriate when located in the container. In embodiments at least the ends of the third and fourth inner sidewall panels closer to the second end of the outer shell are shaped in this manner. Conversely where the first set of further inner shell sidewall panels is located closer to the first end of the outer shell, the ends of at least some of the first set of further inner shell panels closer to the first end of the outer shell may be shaped to help support the neck of a product as appropriate when located in the container. The ends of the second set of further inner shell sidewall panels closer to an end of the container may similarly be shaped to support a product.

The outer shell comprises a plurality of pairs, e.g. two or more pairs, of opposed sidewall panels. The first and second, and third and fourth outer shell sidewall panels provide respective first and second pairs of opposed sidewall panels of the outer shell.

The first and second, and third and fourth inner sidewall panels provide respective first and second pairs of opposed inner sidewall panels. Likewise, in embodiments the first and fifth, and sixth and seventh inner sidewall panels provide respective third and fourth pairs of opposed inner sidewall panels.

The panels of each pair of opposed sidewall panels, whether outer shell or inner shell sidewall panels, preferably extend parallel to one another.

The third and fourth inner sidewall panels preferably extend parallel to the third and fourth outer shell sidewall panels.

The first inner sidewall panel is preferably in face-to-face contact with the inner surface of the first outer shell sidewall panel. The first inner sidewall panel is preferably bonded to the inner surface of the first outer shell sidewall panel. This may be achieved in any suitable manner e.g. using heat sealing. However, preferably the first inner sidewall panel is adhesively bonded to the inner surface of the first outer shell sidewall panel. Advantageously this is achieved using parallel lines of adhesive. This had been found to provide improved strength in the container in comparison to a single central line of adhesive.

In preferred embodiments the first inner shell sidewall panel may be a glue panel. The first inner sidewall panel retains the outer shell in an erect configuration. The first inner shell sidewall panel preferably extends the entire width of the first outer shell sidewall panel over at least a portion of the height of the first inner sidewall panel e.g. in that portion of the height corresponding to the region where the second set of further inner sidewall panels is attached The second inner sidewall panel is preferably in face-to-face contact with the inner surface of the second outer shell sidewall panel. The second inner sidewall panel is preferably bonded to the inner surface of the second outer shell sidewall panel. This may be achieved in any suitable manner e.g. using heat sealing. However, preferably the second inner sidewall panel is adhesively bonded to the inner surface of the second outer shell sidewall panel. Advantageously this is achieved using parallel lines of adhesive. This had been found to provide improved strength in the container in comparison to a single central line of adhesive.

The fifth inner sidewall panel is preferably in face-to-face contact with the inner surface of the second outer shell sidewall panel. The fifth inner sidewall panel is preferably bonded to the inner surface of the second outer shell sidewall panel. This may be achieved in any suitable manner e.g. using heat sealing. However, preferably the fifth inner sidewall panel is adhesively bonded to the inner surface of the second outer shell sidewall panel. Advantageously this is achieved using parallel lines of adhesive. This had been found to provide improved strength in the container in comparison to a single central line of adhesive.

The sixth inner sidewall panel is preferably in face-to-face contact with the inner surface of the third outer shell sidewall panel. The sixth inner sidewall panel is preferably bonded to the inner surface of the third outer shell sidewall panel. This may be achieved in any suitable manner e.g. using heat sealing. However, preferably the sixth inner sidewall panel is adhesively bonded to the inner surface of the third outer shell sidewall panel.

The seventh inner sidewall panel is preferably in face-to-face contact with the inner surface of the fourth outer shell sidewall panel. The seventh inner sidewall panel is preferably bonded to the inner surface of the fourth outer shell sidewall panel. This may be achieved in any suitable manner e.g. using heat sealing. However, preferably the seventh inner sidewall panel is adhesively bonded to the inner surface of the fourth outer shell sidewall panel.

The third inner sidewall panel is spaced from the inner surface of the third outer shell sidewall panel, and the fourth inner sidewall panel is spaced from the inner surface of the fourth outer shell sidewall panel. The stated sidewall panels are spaced from one another over their entire areas. The facing surfaces of the third inner and third outer sidewall panels, and of the fourth inner and fourth outer sidewall panels, do not contact one another.

The panels of the first and second sets of further inner shell sidewall panels preferably do not overlap one another.

The third inner sidewall panel may be attached to the first inner sidewall panel using one or more tabs. The tabs may be glue tabs. In embodiments each tab is released from the third inner sidewall panel. The third inner sidewall panel is connected to the second inner sidewall panel along a foldline along one edge of the third inner sidewall panel. A flap may be connected to the opposite edge of the third inner sidewall panel. The or each tab may have a base which extends from a proximal edge of the flap.

The flap may extend toward a foldline connecting the first inner shell sidewall panel to the second outer shell sidewall panel. The tabs may extend in the opposite direction. The base of each tab may interrupt a foldline connecting the flap to the third inner sidewall panel. In these embodiments, no foldline is provided between the base of the tab and the third sidewall panel. The shape and size of each tab may be selected as desired, and the or each tab provided may or may not be of the same shape and size.

The third and fourth inner sidewall panels may extend between and connect the first and second outer shell sidewall panels.

The fifth and seventh inner sidewall panels may extend the full width of the second and fourth outer shell sidewall panels respectively.

The sixth inner sidewall panel extends over at least a portion of, and optionally only a portion of the width of the third outer shell sidewall panel e.g. at least 65% or at least 75% of the width. The sixth inner sidewall panel may form a distal-most one of the second set of further inner sidewall panels.

At least the second end of the opposed first and second ends of the outer shell is a closed end. The second end may provide a closed base of the outer shell and hence container. Any suitable closure structure may be used e.g. a lid structure or end panel as described below. The second end may or may not be bonded (e.g. using adhesive or heat sealing) in its closed configuration. In preferred embodiments the second end is not bonded in its closed configuration.

The second end may comprise a set of base flaps which may be used to provide a closed base. The base flaps preferably interlock to provide the closed base.

In some embodiments one or more of the outer shell sidewall panels comprise a base flap connected to a second end thereof along a foldline for use in providing a closed base at the second end of the outer shell. The number of outer shell sidewall panels which include such flaps will depend upon the construction of the base. In some embodiments at least the second, third, and fourth outer shell sidewall panels comprise such base flaps.

In some sets of embodiments the container comprises a base flap connected to one of the outer shell sidewall panels along a foldline at the second end thereof, the base flap comprising a base panel and a closure flap connected to a distal end of the base panel, wherein the base flap is folded over base flaps connected to adjacent ones of the outer shell sidewall panels along respective foldlines at the second ends thereof, and the closure flap tucked between the edges of the base flaps connected to the adjacent outer shell sidewall panels and the edge of the outer shell sidewall opposite that to which the base flap comprising the base panel and closure flap is connected to close the base.

In other embodiments the first, second, third and fourth outer shell sidewall panels each comprise base flaps. This may enable a so-called "envelope base" to be obtained.

In embodiments, each one of the first, second, third and fourth outer shell sidewall panels comprises a base flap connected to the second end thereof along a foldline to provide a set of base flaps, the base flaps including;

a first base flap connected along a foldline to one of the sidewalls;

second and third opposed base flaps connected along respective foldlines to respective ones of the sidewalls adjacent the sidewall to which the first base flap is connected on either side thereof, wherein the second and third base flaps are folded over the first base flap;

and a fourth base flap connected along a foldline to a sidewall opposite the sidewall to which the first base flap is connected, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted through a slot defined the first, second and third base flaps into the interior of the container to retain the base in a closed configuration.

The above type of base is known as an "envelope base".

The slot is defined by respective portions of the first, second and third base flaps. Each one of the second and third base flaps may comprise a proximal portion and a distal portion. The slot through which the locking tab portion of the fourth base flap is inserted may be defined by an edge region of the distal portion of each one of the second and third base flaps and an edge defined by the first base flap. The edge regions of the distal portion of the second and third base portions may provide an edge of the slot. The inner edges of the distal portions of the second and third base flaps may be spaced from one another. Thus, there may be a discontinuity along an edge of the slot provided by the edge regions of the distal portions of the second and third base flaps.

The slot may be defined by abutting edges defined by the first, second and third base flaps (e.g. edges of the distal portions of the second and third base flaps), or by an edge defined by the first base flap and underlying surfaces of the second and third base flaps e.g. of the distal portions thereof.

The slot may be defined by an edge region of the distal portion of each one of the second and third base flaps and an edge defined by the first base flap. The first base flap may comprise a recess formed in a distal end thereof, wherein the portion of the distal edge of the first base flap defining a proximal end of the recess provides the edge of the first base flap which cooperates with the edge regions of the second and third base flaps to define the slot through which the locking tab portion of the fourth base flap is inserted. The first base flap may comprise distal portions on either side of the recess.

In some embodiments, the first, second, third and fourth base flaps may be associated with the second, third, fourth and first outer shell sidewall panels respectively.

In embodiments, regardless of the construction of the base, one or more of the first inner sidewall panel and the first set of further inner sidewall panels comprises a reinforcement flap connected to a second end thereof along a foldline, which reinforcement flap is arranged to underlie (i.e. lie inwardly of) one of the base flaps of the outer shell to reinforce the outer shell base flap. Each reinforcement flap will underlie the base flap of a one of the outer shell sidewalls with which the respective inner shell sidewall is in facing relationship. In embodiments the first inner sidewall panel and at least one of the first set of further inner sidewall panels comprises such a reinforcement flap. In embodiments at least the second inner sidewall panel of the first set of further inner sidewall panels comprises a reinforcement flap, and optionally the second inner sidewall panel is the only inner sidewall panel of the first set of further inner sidewall panels which comprises such a reinforcement flap.

A reinforcement flap connected to one of the inner sidewall panels extends over a portion, and optionally only a portion, of the area of the outer shell base flap which it reinforces. This may ensure that the reinforcement flap remains within the outer contour of the associated base flap. The reinforcement flap may be of the same, or different shape to the outer shell base flap.

Preferably the reinforcement flap is unsecured to its outer shell base flap. In these embodiments the base reinforcement flap is unbonded to the base flap e.g. by adhesive or any other form of attachment.

The reinforcement base flap is in a facing relationship with its respective base flap, and is preferably in face to face contact with the inner surface of its respective base flap. The outer surface of the reinforcement flap faces, or preferably is in contact with the inner surface of the base flap.

Such arrangements are particularly advantageous in the context of an envelope type base.

In embodiments, each one of the first, second, third and fourth outer shell sidewall panels comprises a base flap connected to the second end thereof along a foldline to provide a set of base flaps, the base flaps including;

a first base flap connected along a foldline to one of the sidewalls;

second and third opposed base flaps connected along respective foldlines to respective ones of the sidewalls adjacent the sidewall to which the first base flap is connected on either side thereof, and wherein the second and third base flaps are folded over the first base flap;

and a fourth base flap connected along a foldline to a sidewall opposite the sidewall to which the first base flap is connected, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted through a slot defined by the first, second and third base flaps into the interior of the container to retain the base in a closed configuration.

Preferably one or more of the first inner sidewall panel and the first set of further inner sidewall panels comprises a reinforcement flap connected to a second end thereof along a foldline, which reinforcement flap is arranged to underlie one of the base flaps of the outer shell to reinforce the outer shell base flap.

Each reinforcement flap will underlie the base flap of a one of the outer shell sidewalls with which the respective inner shell sidewall is in facing relationship. In embodiments the first inner sidewall panel and at least one of the first set of further inner sidewall panels comprises such a reinforcement flap. In embodiments at least the second inner sidewall panel of the first set of further inner sidewall panels comprises a reinforcement flap, and optionally the second inner sidewall panel is the only inner sidewall panel of the first set of further inner sidewall panels which comprises such a reinforcement flap. The first, second, third and fourth base flaps may be associated with the second, third, fourth and first outer shell sidewall panels respectively. Thus, reinforcement flaps may be provided for at least, and optionally only, for the first and fourth base flaps.

In general, reinforcement flaps are preferably provided at least, an optionally only, for the first and fourth base flaps.

The Applicant has realised that providing reinforcing base flaps associated with the inner sidewall panels may enable portions of the sheet from which a blank for providing the container is cut to be utilised to obtain a stronger base for the container, which sheet portions would otherwise be wasted.

The container may further comprise any suitable closure structure at the first end thereof. For example, a lid structure may be provided, which may be of the same type used in certain embodiments in respect of the second end of the container. The lid structure may provide a releasable and refastenable closure.

Alternatively the first and/or second end of the outer shell may be bonded closed (e.g. using adhesive or heat sealing).

The first end of the outer shell may be the end through which a product located in the container is intended to be initially viewed or withdrawn in use (the end through which a product is withdrawn may depend upon the shape of the product and any cooperating product support features). This end may be referred to as the "top" end of the container, although this does not imply any required orientation of the container in use. The first or "top" end refers to the end opposite to the second or bottom end of the outer shell (or container) which may define a base for the container. However, it will be appreciated that this again does not imply any particular orientation of the container in use, and terms such as "top", "bottom", and base are used merely to distinguish the ends of the container/inner shell/outer shell from one another for the purposes of illustrating certain features of the invention.

The first end of the outer shell may be a closed end. As with the second end, the first end of the container may or may not then be bonded in its closed configuration. Any suitable end closure structure may be used. Generally the end closure may comprise an end panel or lid panel and a pair of end flaps underlying the end panel or lid panel.

It will be appreciated that any combination of bonded and releasable closures may be used at the ends of the product e.g. a releasable and refastenable lid structure at the first end and a bonded closure at the second end. Where a bonded closure is provided at either end of the outer shell, a refastenable closure feature may be provided in respect of that end. It is also envisaged that the first end may be an open end, with no closure feature.

The container of the present invention may be used to receive any type of product. The product is located within the inner shell in use. The present invention extends to a container in accordance with the invention in any of its aspects or embodiments having a product located therein. The product may be a container, e.g. a bottle, such as a drinks bottle. However this is only one example of the type of product which may be held by the container. The container is particularly useful in conjunction with fragile products where it is desired to protect the product from impact. Product may be loaded into the inner shell from either end, depending upon the configuration of any product support features, with the applicable end of the outer shell then being closed.

The container may include any suitable features to assist in supporting a product in the container.

The present invention extends to a blank erectable to provide a container in accordance with any of the embodiments herein described. The blank is a single piece blank.

The blank may comprise a first subset of panels connected to one another along respective foldlines for providing the sidewall panels of the outer shell;

a first inner sidewall panel connected on one side along a foldline to one of the first subset of panels for providing the first inner sidewall panel of the container;

a second subset of panels connected to one another along respective foldlines for providing the first further set of inner sidewall panels, wherein one of the second subset of panels is connected to the first inner sidewall panel along the other side thereof along a foldline;

and a third subset of panels connected to one another along respective foldlines for providing the second further set of inner sidewall panels, wherein one of the third subset of panels is connected to the first inner sidewall panel along said other side thereof along a foldline.

In embodiments the foldline connecting said one of the second subset of panels to the first inner sidewall panel is offset from the foldline connecting said one of the third subset of panels to the first inner sidewall panel.

In embodiments adjacent edges of the second and third subsets of panels are separated from one another by a cutline. The edges are the abutting edges. A cutline refers to a cut made in the material of the blank without the removal of any of the material.

The panel of the first subset of panels which is connected along a foldline to the first inner sidewall panel is for providing the third outer shell sidewall panel. A panel for providing the second outer shell sidewall panel is connected along a foldline to the panel for providing the third outer shell sidewall panel. A panel for providing the fourth outer shell sidewall panel is connected along a foldline to the panel for providing the second outer shell sidewall panel. A panel for providing the first outer shell sidewall panel is connected along a foldline to the panel for providing the fourth outer shell sidewall panel.

The panel of the second subset of panels which is connected along a foldline to the first inner sidewall panel may be for providing the fourth inner sidewall panel. A panel for providing the second inner sidewall panel is connected along a foldline to the panel for providing the fourth inner sidewall panel. A panel for providing the third inner sidewall panel is connected along a foldline to the panel for providing the second inner sidewall panel.

The panel of the third subset of panels which is connected along a foldline to the first inner sidewall panel may be for providing the seventh inner sidewall panel. A panel for providing the fifth inner sidewall panel is connected along a foldline to the panel for providing the seventh inner sidewall panel. A panel for providing the sixth inner sidewall panel is connected along a foldline to the panel for providing the fifth inner sidewall panel.

The foldline between the panels for providing the second and fourth inner sidewall panels is offset from the foldline between the panels for providing the fifth and seventh inner sidewall panels.

The foldline between the panels for providing the second and third inner sidewall panels is offset from the foldline between the panels for providing the fifth and sixth inner sidewall panels.

The offset between foldlines of the blank is a lateral offset. This is along a direction corresponding to the direction connecting the sides of the first inner sidewall panel i.e. which are connected to the first subset of panels and the second and third subsets of panels respectively. The blank thus defines a first direction corresponding to the direction connecting the sides of the first inner sidewall panel. The offset is along this first direction. The blank defines a second direction corresponding to a direction which extends between the first and second ends of the container when erected. This may correspond to a direction connecting ends of the first inner sidewall panel in the blank.

The adjacent edges of the ones of the second and third subsets of panels which are separated by the cutline are those ends which will be furthest from the ends of the outer shell/container.

A plurality of the panels of the first subset of panels may comprise flaps for providing base flaps connected thereto at an end (i.e. the second end) thereof.

One or more panels of the second subset of panels may comprise flaps for providing reinforcement flaps connected thereto at an end (i.e. the second end) thereof.

The first inner sidewall panel comprises first and second opposed ends. The blank defines first and second ends of the blank. These may correspond to the first and second ends of the first inner sidewall panel.

In accordance with the invention in any of its aspects or embodiments, the container is made from a foldable sheet material such as paperboard or cardboard, or even a plastics material. The material may be chosen as desired. Preferably the material is a non-plastics material.

In accordance with the invention in any of its aspects or embodiments, the container may be made of cardboard, paperboard or other lightweight foldable sheet material.

A fold line as referred to herein refers to any line about which components have been folded. The fold line may comprise a line of weakness, crease line and/or perforations. If not explicitly stated, and unless inconsistent therewith, any connection described herein may be about a fold line.

Any reference to a height refers to a dimension as measured in the direction extending between the first and second ends of the outer shell (or inner shell or container as appropriate). A width of a sidewall panel is measured in the direction connecting the opposed edges of the sidewall panel. The width dimension may be measured in a direction perpendicular to a direction connecting the first and second ends of the outer shell/container.

The term "at least some" refers to one or more.

Where panels are described as being in face-to-face contact, the panels are in face-to-face contact over at least a portion, and optionally the entire area of their facing surfaces, unless the context demands otherwise.

The present invention in accordance with any of its further aspects or embodiments may include any of the features described in reference to other aspects or embodiments of the invention to the extent it is not mutually inconsistent therewith.

BRIEF DESCRIPTION OF DRAWINGS

Some preferred embodiments of the invention will now be described by way of example only and with reference to the followings drawings, of which.

DETAILED DESCRIPTION

Figure 1:
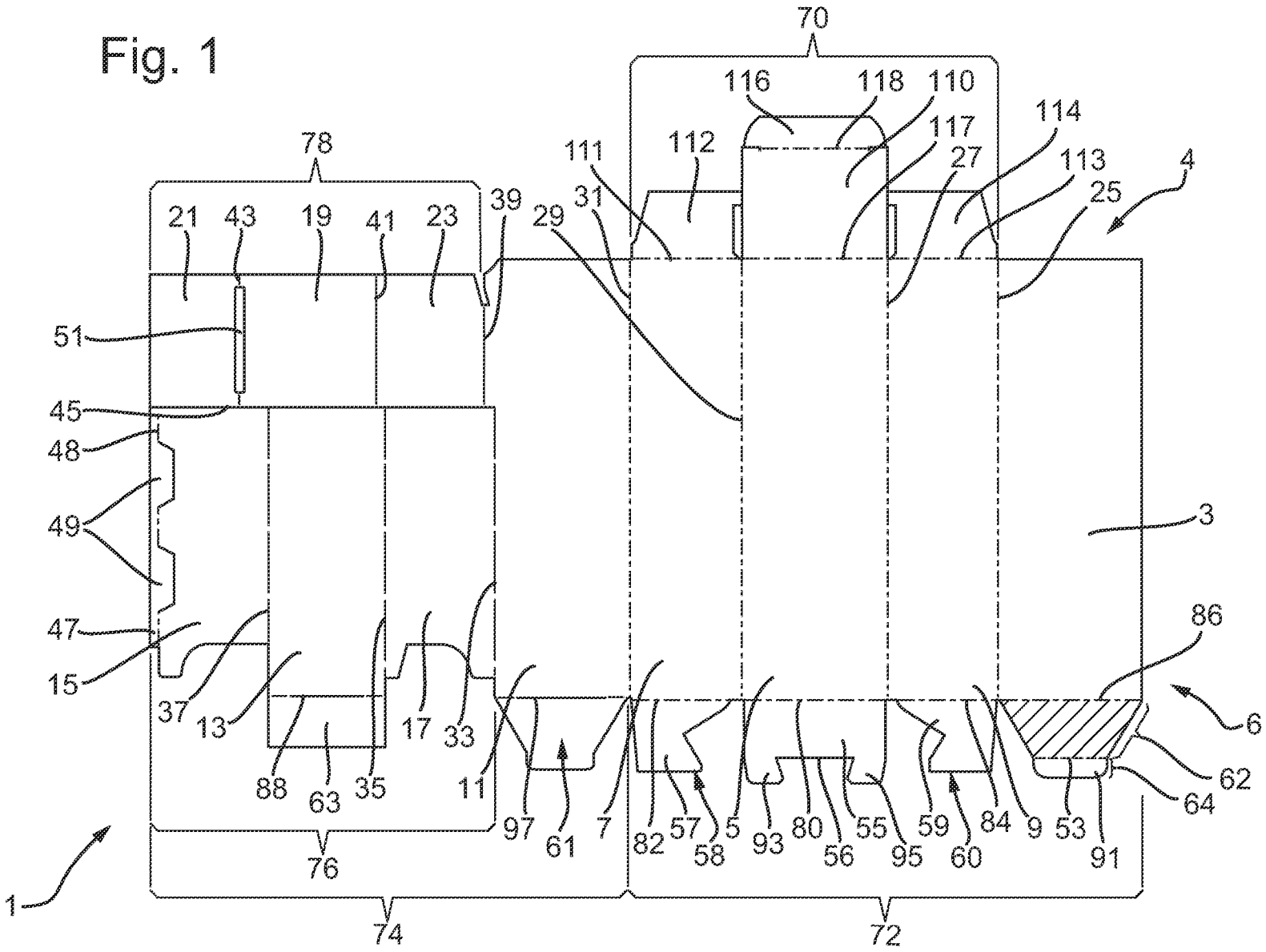
FIG. 1 shows a blank in the flat for forming a container in accordance with a first embodiment of the present invention.

With reference to FIG. 1, a blank for providing a container in accordance with a first embodiment of the invention will now be described.

FIG. 1 shows the blank in the flat from above, from the side which will provide portions of the exterior surface of the erected container.

The blank has a first end 4 which provides a first end of the container when erected, and a second end 6 which provides a second end of the container when erected. The second end of the container is a base of the container.

The blank 1 includes an outer sub-assembly 72 for providing an outer shell and associated components of the container, and an inner sub-assembly 74 for providing interior sidewalls and associated components of the container.

The outer sub-assembly 72 includes a first outer shell sidewall panel 3, a second outer shell sidewall panel 5, a third outer shell sidewall panel 7, and a fourth outer shell sidewall panel 9. The first and fourth outer shell sidewall panels 3, 9 are connected by a foldline 25. The second and fourth outer shell sidewall panels 5, 9 are connected by a foldline 27. The second and third outer shell sidewall panels are connected by a foldline 29.

An array of flaps 70 is connected to the first ends of the second, third and fourth outer shell sidewall panels 5, 7, 9 for forming a closed lid structure at the first end of the container erected from the blank. The flaps include a lid panel flap 110 having a closure flap 116 at a distal end thereof, and connected to the lid panel flap 110 along a foldline 118. The lid panel flap 110 is connected along a foldline 117 to the second outer shell sidewall panel 5. The lid flap array 70 also includes second and third side flaps 112, 114 connected along respective foldlines 111, 113 to the third and fourth outer shell sidewall panels 7, 9 respectively.

A first base flap 55, is connected to the second end of the second outer shell sidewall panel 5 along a foldline 80. The distal end of the first base flap 55 defines a recess. The proximal end of the recess is provided by an edge 56. The first base flap 55 has distal portions defining hooks 93, 95 on either side of the recess.

A second base flap 57 is connected to the second end of the third outer shell sidewall panel 7 along a foldline 82. A third base flap 59 is connected to the second end of the fourth outer shell sidewall panel 9 along a foldline 84, and a fourth outer shell base flap 53 is connected along a foldline 86 to the second end of the first outer shell sidewall panel 3. These base flaps may be used to provide an envelope type base closure. It will be seen that the distal portions of the second and third base flaps 57, 59 define hooks 58, 60 respectively. The fourth base flap 53 has a distal end portion 91.

As described below, in the closed base, the hooks 58, 60 of the second and third base flaps 57, 59 engage behind the edge 56, and the distal portions of the second and third base flaps 57, 59 and the edge 56 define a slot through which the distal end portion 91 of the fourth base flap 53 is inserted into the interior of the container. The fourth base flap 53 defines a base panel portion 62 and a locking tab portion 64. The base panel portion 62 forms part of the exterior of the base in the erected container, while the locking tab portion 64 is located to the interior of the base. The base panel portion is denoted in hatched lines. However, this is merely to facilitate understanding of the arrangement. It will be appreciated that there is preferably no foldline or other feature distinguishing the portions of the fourth base flap 53 from one another.

The inner sub-assembly 74 includes a first inner sidewall panel 11, which is connected to the third outer shell sidewall panel 7 along a foldline 31. The first inner sidewall panel 11 provides a glue panel which is connected to the interior surface of the first outer shell sidewall panel 3 when erecting the container from the blank.

The inner sub-assembly 74 also includes a first set of further inner sidewall panels 76, connected to the first inner sidewall panel 11 along a foldline 33. The first set of further inner sidewall panels 76 includes a fourth inner sidewall panel 17 connected to the first inner sidewall panel 11 along the foldline 22, a second inner sidewall panel 13 connected to the fourth inner sidewall panel along a foldline 35, and a third inner sidewall panel 15 connected to the second inner sidewall panel 13 along a foldline 37.

A first base reinforcement flap 63 is connected to the second end of the second inner sidewall panel 13 along a foldline 88, and lies inside the first base flap 55 to reinforce the base flap 55 when the base is closed. The first base reinforcement flap 63 has a smaller area than the first base flap 55, so as to fit within the outer contour of the portion of the first base flap proximal to the recess of the first base flap 55.

A second base reinforcement flap 61 is connected to the second end of the first inner sidewall panel 11 along a foldline 97, and lies inside the fourth base flap 53 to reinforce the base flap 53 when the base is closed. The second base reinforcement flap 61 has the same shape as the fourth base flap 53, but a smaller area, so as to lie within the outer contour of the fourth base flap 53.

A flap 47 is connected along a foldline 48 to the distal edge of the third inner sidewall panel 15. Two glue tabs 49 are provided, being released from the third inner sidewall panel 15, and having a base extending from the proximal edge of the flap 47. In this way, the glue tabs 49 interrupt the foldline 48.

Figure 6:
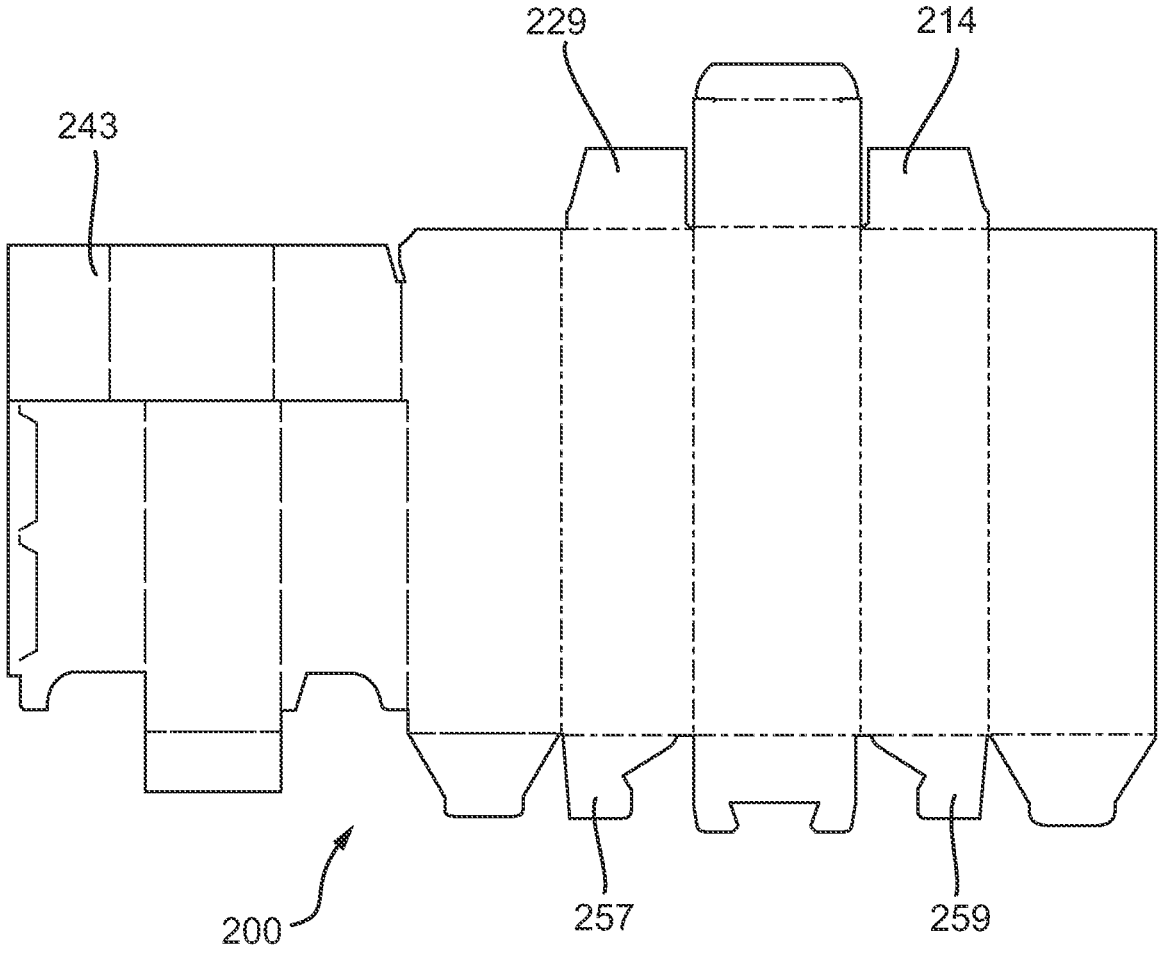
FIG. 6 illustrates a blank in the flat for providing a container in accordance with a second embodiment of the invention.

The inner sub-assembly 74 also includes a second set of further inner sidewall panels 78, connected to the first inner sidewall panel 11 along a foldline 39. The second set of further inner sidewall panels 78 is located between the first set of further inner sidewall panels 76 and the first end 4 of the blank. The second set of further inner sidewall panels 76 includes a seventh inner sidewall panel 23 connected to the first inner sidewall panel 11 along the foldline 39, a fifth inner sidewall panel 19 connected to the seventh inner sidewall panel along a foldline 41, and a sixth inner sidewall panel 21 connected to the fifth inner sidewall panel 19 along a foldline 43. The foldline 43 includes a slot 51 extending along a portion of the length thereof. This slot has been found to be advantageous in avoiding bunching of material at the join between the fifth and sixth sidewall panels 19, 21 when the container is erected. Similar slots may be used along other ones of the foldlines e.g. 41, 39, 33, 35, 37 connecting inner sidewall panels if desired. In yet other embodiments, the slot may be omitted, as shown in FIG. 6.

A cutline 45 separates the adjacent ends of the inner sidewall panels of the first and second sets of further inner sidewall panels 76, 78 from one another. The cutline 45 extends beyond the foldline 39 connecting the second set of further sidewall panels 78 to the first inner sidewall panel 11. The adjacent edges of the inner sidewall panels of the first and second further sets of inner sidewall panels 76, 78 may be connected by frangible bridges of material in the blank (not shown in FIG. 1), to help maintain integrity of the blank during loading and feeding stages. Any suitable number and spacing of such frangible bridges may be used to hold the sets of panels together as required to facilitate handling. The most suitable configuration e.g. number, size and position of the bridges will depend upon factors such as the properties of the material of the blank e.g. basis weight, type of material. The frangible bridges of material may be broken in an initial stage of the erection process as described below.

It may be seen that the foldlines 41, 43 separating panels of the second set of further inner sidewall panels 78 are offset from the foldlines 35, 37 separating panels of the first set of further inner sidewall panels 76 from one another. The foldline 39 connecting the second set of further sidewall panels 78 to the first inner sidewall panel 11 is offset from the foldline 33 connecting the first set of further sidewall panels 76 to the first inner sidewall panel 11.

The foldlines 33, 35, 37 and 39, 41 connecting the sidewall panels within the first and second sets of further inner sidewall panels, and connecting the respective sets of further inner sidewall panels to the first inner sidewall panel 11 comprise a plurality of slits. The slits help to further weaken the foldlines between the panels, ensuring that folding reliably occurs where intended. The use of such slits is advantageous, as the foldlines 33, 35, 37 are offset from foldlines 39, 41, 43, and it the use of the slits may help to aid folding naturally occurs along the intended positions of the offset foldlines. The number and length of the slits may differ from that shown, and may be selected depending upon factors such as the properties of the material of the blank e.g. sheet strength, basis weight etc., and the sizes of the panels. Depending upon the configuration of the panels and/or the material properties, it is envisaged that such slits may not always be required.

One way in which the blank 1 may be used to provide a container will now be described by reference to FIGS. 2A-E and 3A-C.

Figure 2A:
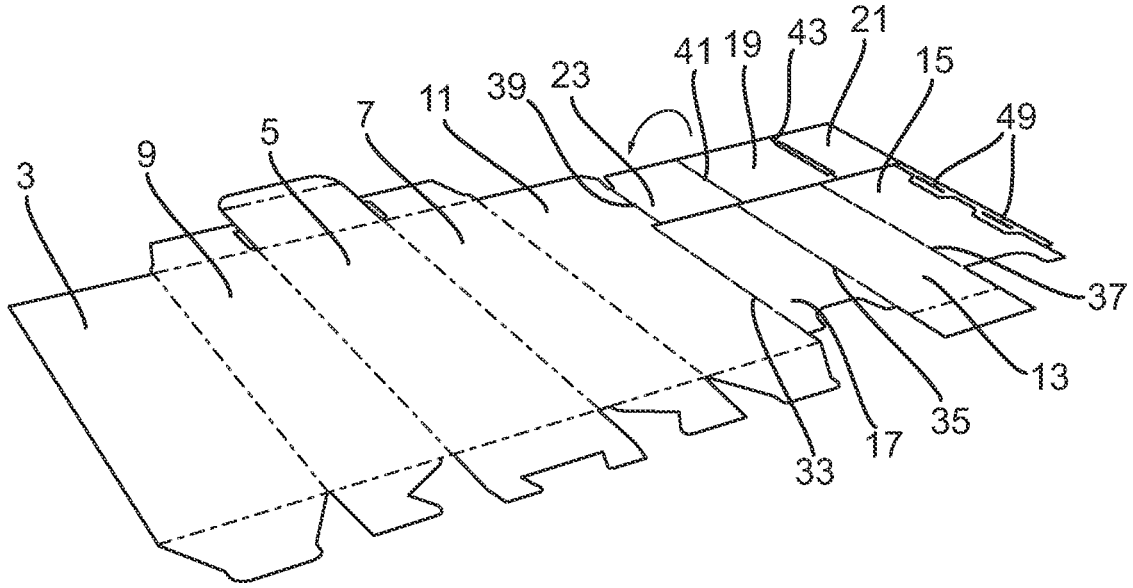
FIG. 2A illustrates the blank of FIG. 1 after a first folding and gluing step in a flat configuration.

FIG. 2A illustrates the blank in the flat from above, with the surface which will be located to the interior of the container uppermost i.e. the opposite surface to that which is uppermost in FIG. 1.

Where the adjacent edges of the first and second sets of further inner sidewall panels 76, 78 are connected by frangible bridges of material to facilitate handling of the blank during loading and feeding of the blank, in an initial step, the panels are pre-folded to break the frangible bridges.

Figure 2B:
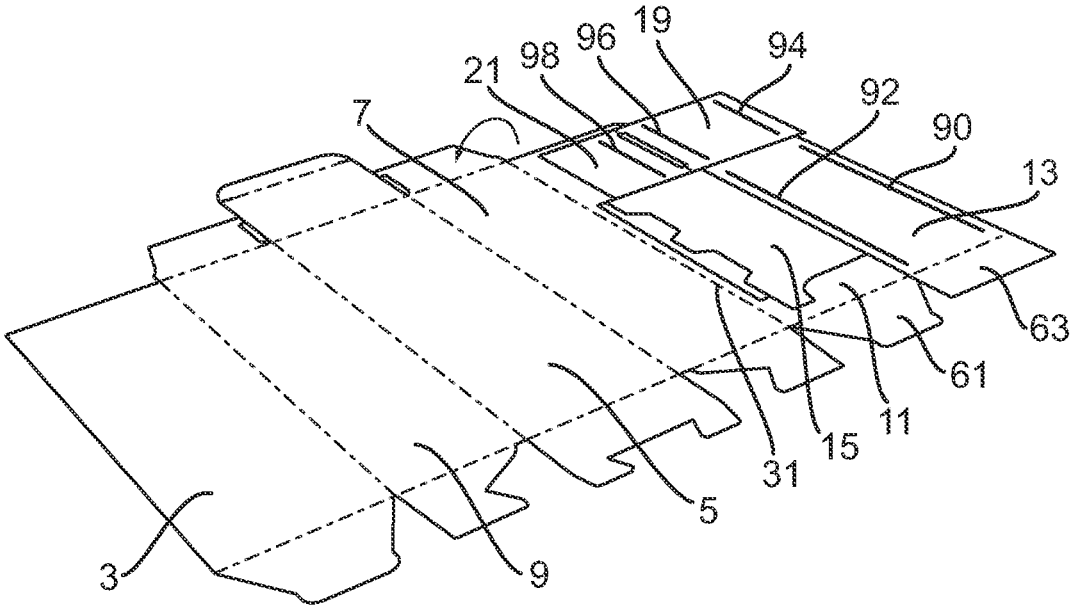
FIG. 2B illustrates the blank of FIG. 2A after a second folding and gluing step in a flat configuration.

In a first step, glue is applied to the interior surfaces of the glue tabs 49. The blank is folded in the direction of the arrow shown in FIG. 2A along the offset foldlines 41, 35 connecting the fifth and seventh inner sidewall panels, and the second and fourth inner sidewall panels 13, 17 respectively. This provides a folded blank as shown in FIG. 2B. The glue tabs 49 are adhered to the inner surface of the first inner sidewall panel 11.

In step 2, glue is applied to the exterior surfaces of the second inner sidewall panel 13, the fifth inner sidewall panel 19 and the sixth inner sidewall panel 21. The glue is advantageously provided in the pattern shown, including two parallel lines 90, 92 extending along length of the second inner sidewall panel 13, and two parallel lines 94, 96 extending along length of the fifth inner sidewall panel 19. A single line of glue 94 may be applied to the sixth inner sidewall panel. Of course, other glue configurations may be used. However, it has been found that applying two glue lines to each of the larger panels may provide advantages in terms of strength in comparison to using a single glue line in the centre of the panel. It will be appreciated that the glue lines 90, 94 applied to the second and fifth inner sidewall panels 13, 19 may be applied as part of the same glue line i.e. in the same pass of a glue head. The same applies to the glue lines 92, 96. The glue lines 90, 92, 94 may be lines of cold glue.

Figure 2C:
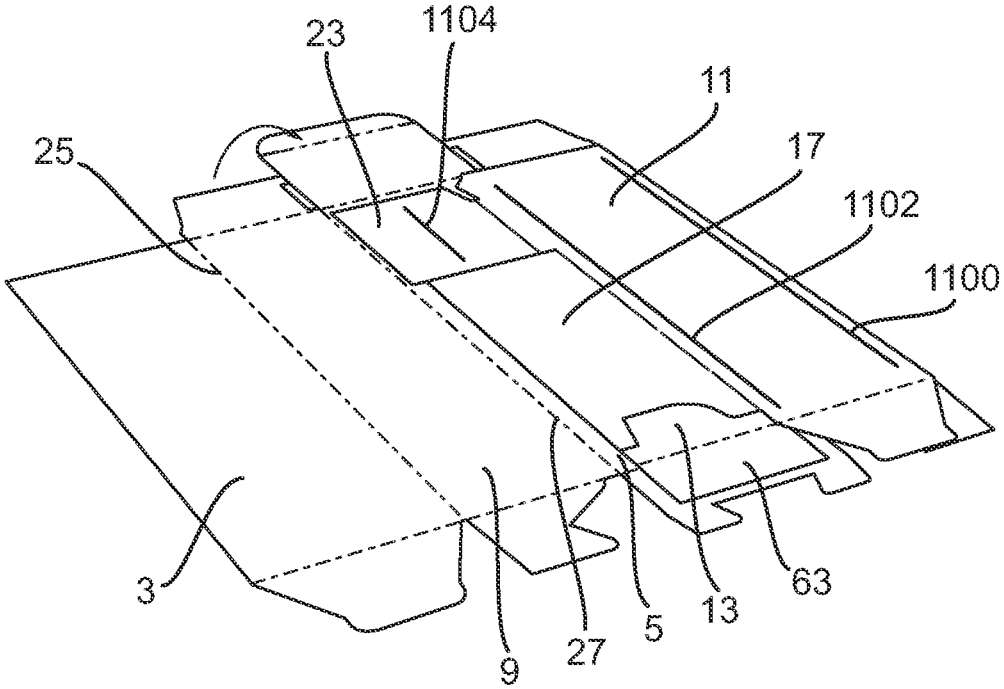
FIG. 2C illustrates the blank of FIG. 2B after a third folding and gluing step in a flat configuration.

The blank is then folded in the direction of the arrow shown in FIG. 2B along the foldline 31 connecting the first inner sidewall panel 11 to the third outer shell sidewall panel 7 to provide a folded blank as shown in FIG. 2C.

The second inner sidewall panel 13 and the fifth inner sidewall panel 19 will become adhered to the inner surface of the second outer shell sidewall panel 5. The sixth inner sidewall panel 21 will become adhered to the third outer shell sidewall panel 7.

In step 3, glue is applied to the exterior surfaces of the first inner sidewall panel 11, and the seventh inner sidewall panel 23. Again, advantageously the glue pattern shown is used. In this pattern a single line of glue 1104 is applied to the centre of the seventh inner sidewall panel 23. However, a pair of glue lines 1100, 1102 is applied to each side of the first inner sidewall panel 11. This arrangement may provide improved strength in comparison to using a single glue line on the larger panel 11. However, depending upon the desired use of the container, and its shape etc. improved strength properties may not be a key consideration. In some situations, it has been found that the seventh inner sidewall panel 23 may be unadhered to the fourth outer shell sidewall panel 9 while still providing a sufficiently close contact between the facing surfaces of the panels, and in these embodiments, glue is not applied to the seventh inner sidewall panel 23.

Figure 2D:
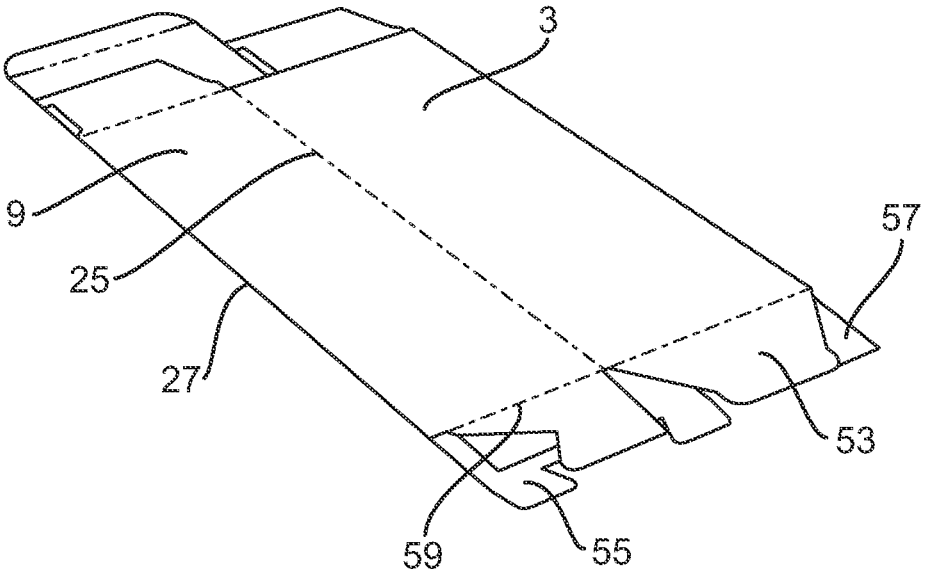
FIG. 2D illustrates the blank of FIG. 2C after a fourth folding and gluing step in a flat configuration.

The blank is now folded in the direction of the arrow shown in FIG. 2C about the foldline to provide a folded blank as shown in FIG. 2D. The inner surface of the first outer shell sidewall panel 3 becomes adhered to the outer surface of the first inner sidewall panel 11, and the inner surface of the fourth outer shell sidewall panel 9 becomes adhered to the outer surface of the seventh inner sidewall panel.

Figure 2E:
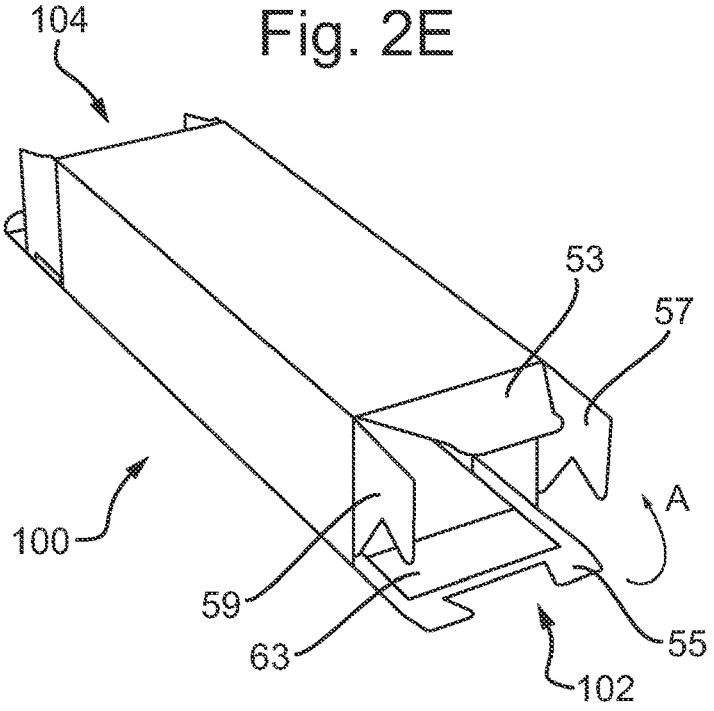
FIG. 2E illustrates the blank of FIG. 2D after erection into a 3-dimensional state, with both ends in an open configuration'

In step 4, the folded and glued blank is caused to change from the flat configuration shown in FIG. 2D to a 3-dimensional configuration as shown in FIG. 2E. The erected container is referred to as 100. This may occur at a different time and place to steps 2A-D if required. Thus, the folded, glued blank may be supplied in the form shown in FIG. 2D for final erection. Conversion of the flat folded and glued blank shown in FIG. 2D to the configuration shown in FIG. 2E may be achieved by applying suction to the surface lying uppermost in FIG. 2D, or by urging the sides of the folded blank inwardly, or in any suitable manner.

After step 2E, the first and second ends of the container 102, 104, provided by the first and second ends 4, 6 of the blank respectively are open.

Figure 2F:
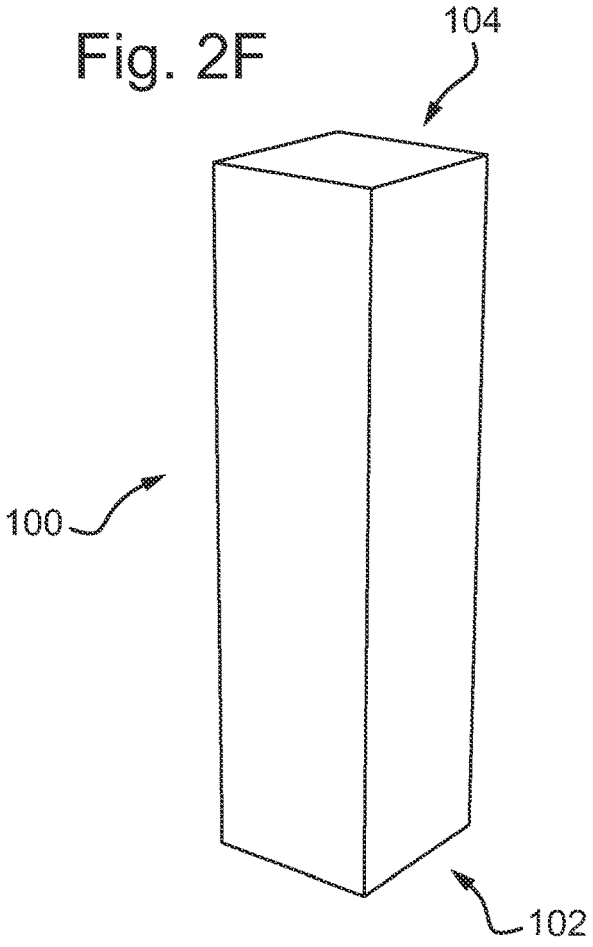
FIG. 2F illustrates a container obtained by closing the first and second ends of the erected blank of FIG. 2E.

In a final step 5, the first and second ends of the container are closed to provide the container 100 with closed first and second ends as shown in FIG. 2F. The manner in which the base flaps associated with the second end of the container are used to close the base will be described in more detail below by reference to FIGS. 3A-C. The first end of the container is closed in a conventional manner by folding the lid panel flap 110 associated with second outer shell sidewall panel 5 over the side flaps 112, 114 associated with the third and fourth outer shell sidewall panels 7, 9 and tucking in the closure flap 116 associated with the lid panel flap. The lid and base may be closed in any order, sequentially or simultaneously. A product is inserted in the container before both ends are closed. Typically the base is closed, the product inserted, and the first end then closed, although other options may be envisaged.

Figure 3A:
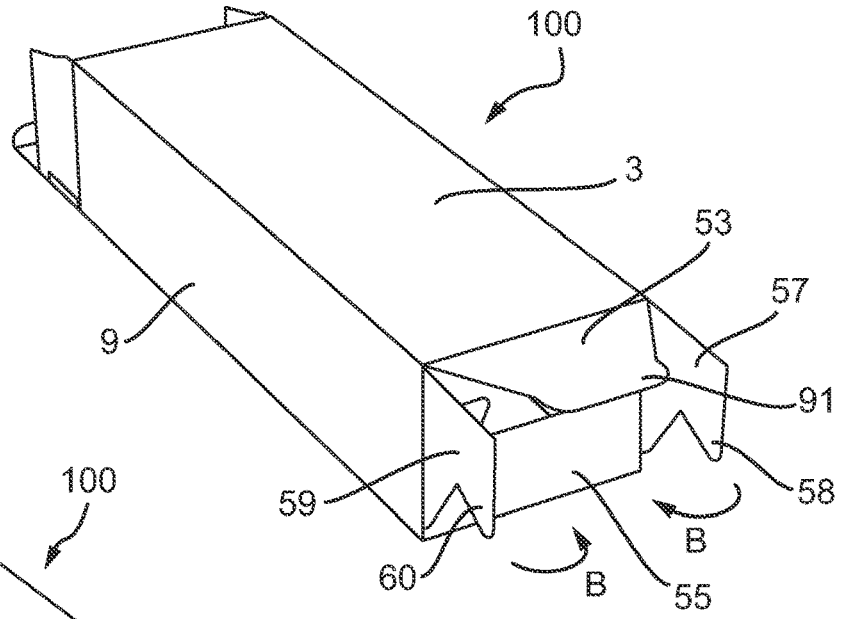
FIG. 3A illustrates a first step in the closure of the base of the container of the erected blank of FIG. 2E in accordance with one embodiment for obtaining the container of FIG. 2F.

One way in which the base may be closed will now be described by reference to FIGS. 3A-C. In a first step the first base flap 55 associated with the second end of the second outer shell sidewall panel 5 is rotated through 90 degrees (in the direction of arrow A in FIG. 2E) about foldline 80 from the position shown in FIG. 2E to the position shown in FIG. 3A. This causes the first base reinforcement flap 61 connected to the first inner sidewall panel 11, and which underlies the first base flap 55, to simultaneously be rotated around foldline 97.

Figure 3B:
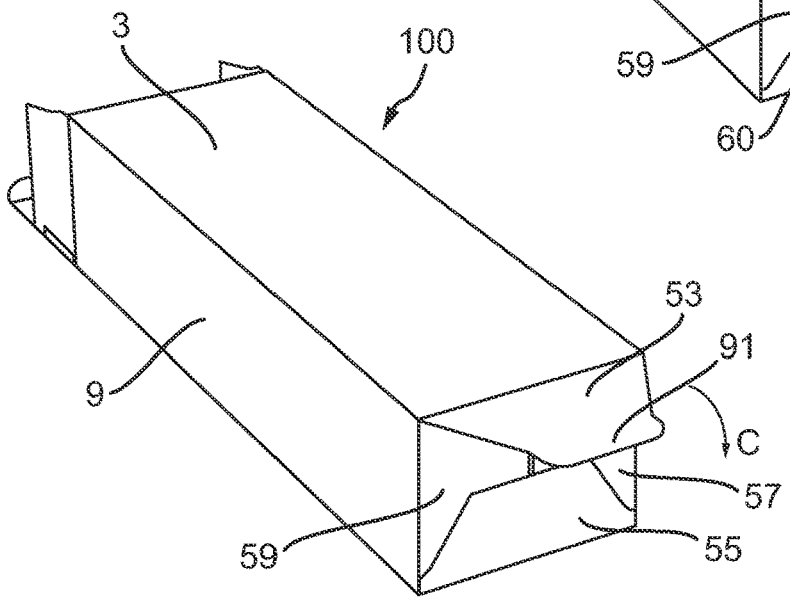
FIG. 3B illustrates a second step in the closure of the base of the container of the erected blank of FIG. 2E in accordance with one embodiment for obtaining the container of FIG. 2F.
Figure 3C:
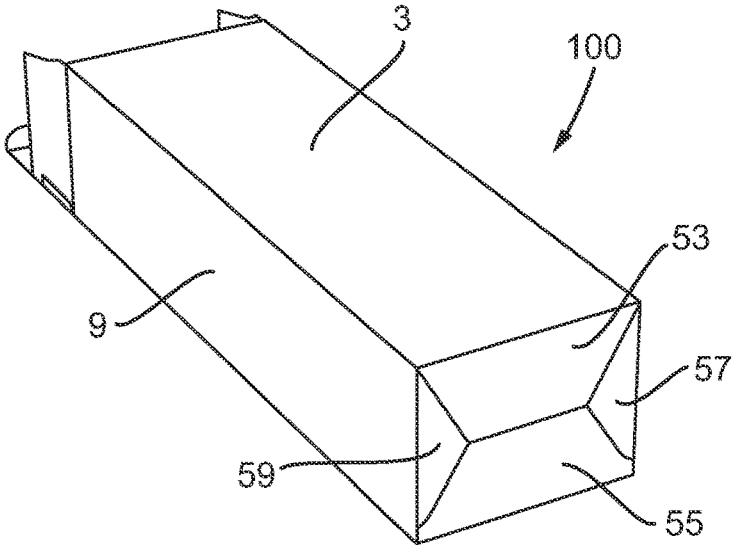
FIG. 3C illustrates a third step in the closure of the base of the container of the erected blank of FIG. 2E in accordance with one embodiment for obtaining the container of FIG. 2F.

In a second step, the second and third base flaps 57, 59 associated with the second ends of the third and fourth outer shell sidewall panels 7, 9 respectively are rotated through 90 degrees about the foldlines 82, 84 (in the direction of arrows B in FIG. 3A) to the position shown in FIG. 3B so as to overlie the first base flap 55.

In a third step the fourth base flap 53 connected to the first outer shell sidewall panel 3 is folded about the foldline 86 (in the direction of arrow C in FIG. 3B) and its distal end pushed toward the interior of the container to the position. This causes the second base reinforcement flap 61 connected to the first inner sidewall panel 11, and which underlies the first base flap 55, to simultaneously be rotated around foldline 97, with the distal end of the base reinforcement flap 61 being pushed with the distal end of the fourth base flap 53 into the interior of the container.

The movement of the fourth base flap 53 and the underlying second base reinforcement flap 61 into the interior of the container pushes the hooks 58, 60 of the distal portions of the second and third base flaps 57, 59 behind the edge 56 defined by the recess at the distal end of the first base flap 55, with the locking tab portion 64 of the fourth base flap 53 (and the distal end portion of the underlying second base reinforcement flap 61) being inserted through a slot thus defined by the edge 56 and the distal portions of the second and third base flaps 57, 59. The locking tab portion 64 of the fourth base flap 53 (and the distal end portion of the underlying second base reinforcement flap 61) is disposed in the interior of the container in the closed base, while the base panel portion 62 forms part of the exterior of the base. In the closed base, the hooks 58, 60 help to prevent movement of the locking tab portion 62 of the fourth base flap 53 (or the distal end portion of the second base reinforcement flap 61) out of the slot once more, and thus helps to avoid the base undesirably coming open when an outwardly directed force is exerted on the interior thereof by a product located in the container.

The resulting closed base resembles the reverse of an envelope, and may be referred to as an "envelope base" closure.

It will be seen that in the embodiment illustrated, the base reinforcement flaps 63, 61 underlie the first and fourth base flaps 55, 53 respectively, providing additional strength to the base.

It will be appreciated that the locking tab portion 62 of the fourth base flap 53 extends through a slot as described in the closed base. The slot may not necessarily exist prior to insertion of the fourth base flap into the interior of the container e.g. if the second and third base flaps comprise distal ends which hook behind the edge 56 of the first base flap 55.

Of course, the closure of the base need not be performed in exactly the manner above-described. For example, the hooks of the second and third base flaps 57, 59 may be engaged behind the edge 56 of the first base panel 55 in a separate step, prior to pushing the distal end of the fourth base flap 53 toward the interior of the container. Likewise, the steps of folding and gluing the blank need not be performed as illustrated with respect to FIGS. 2A-D. For example, the order of steps, and/or the lines along which folding occurs may differ. Any suitable methods may be used which result in a container as shown in FIG. 2F, and described further by reference to FIGS. 4A and B.

The shape of the first, second, third and fourth base flaps 53, 55, 57, 59 need not be as shown. For example, the distal portions of the second and third base flaps 57, 59 need not define hooks. The distal portions may include straight side edges which extend along the edge 56 of the first base flap 55 to define the slot through which the distal end portion 91 of the fourth base flap 53 is inserted. Such an arrangement may be provided where the side edge of the distal portion of the base flap extends substantially perpendicular to the end edge of the flap. However, the use of hooks may provide a stronger base construction. Alternatively or additionally, the distal portions 93, 95 of the first base flap 55 need not necessarily define hooks. The opposed inner side edges of the distal portions which provide side edges of the recess in the distal end of the first base flap 55 may be extend parallel to one another. However, the use of hooks may again provide a stronger base construction, helping to retain the second and third base flaps 57, 59 in position in the closed base.

The shapes of the first and second base reinforcement flaps 63, 61 may differ from that shown. For example, the shape of the first base reinforcement flap may correspond to that of the first base flap 55 i.e. including a recess, with the first base reinforcement flap being of smaller area than the first base flap 55 to ensure that it fits within the contour thereof, in a similar manner to the first base reinforcement flap 61 and the fourth base flap 53.

Where hooks are provided on any or all of the second, third or first base flaps, the configuration of the hooks, e.g. the steepness of the angle defined at the distal end thereof, and/or the length of the hooks may be varied as desired. The shape of any of the base flaps may be varied as desired e.g. to provide a base closure of required strength for a given application, provided that the flaps may interact in the manner described.

The first and second base reinforcement flaps 63, 61 may be omitted if desired e.g. if a stronger base construction is not required.

Finally, although an envelope base closure has been described, any suitable method of providing a closed base may be used, which may or may not involve the use of adhesive or other bonding to retain the base in its closed configuration.

In the erected container 100 e.g. as shown in FIG. 2F, the second set of further inner sidewall panels 78 cooperates with the portion of the first inner sidewall panel 11 toward the second end of the container to provide an internal fitment reducing the interior space within the container in the region closer to the second end.

Figure 4A:
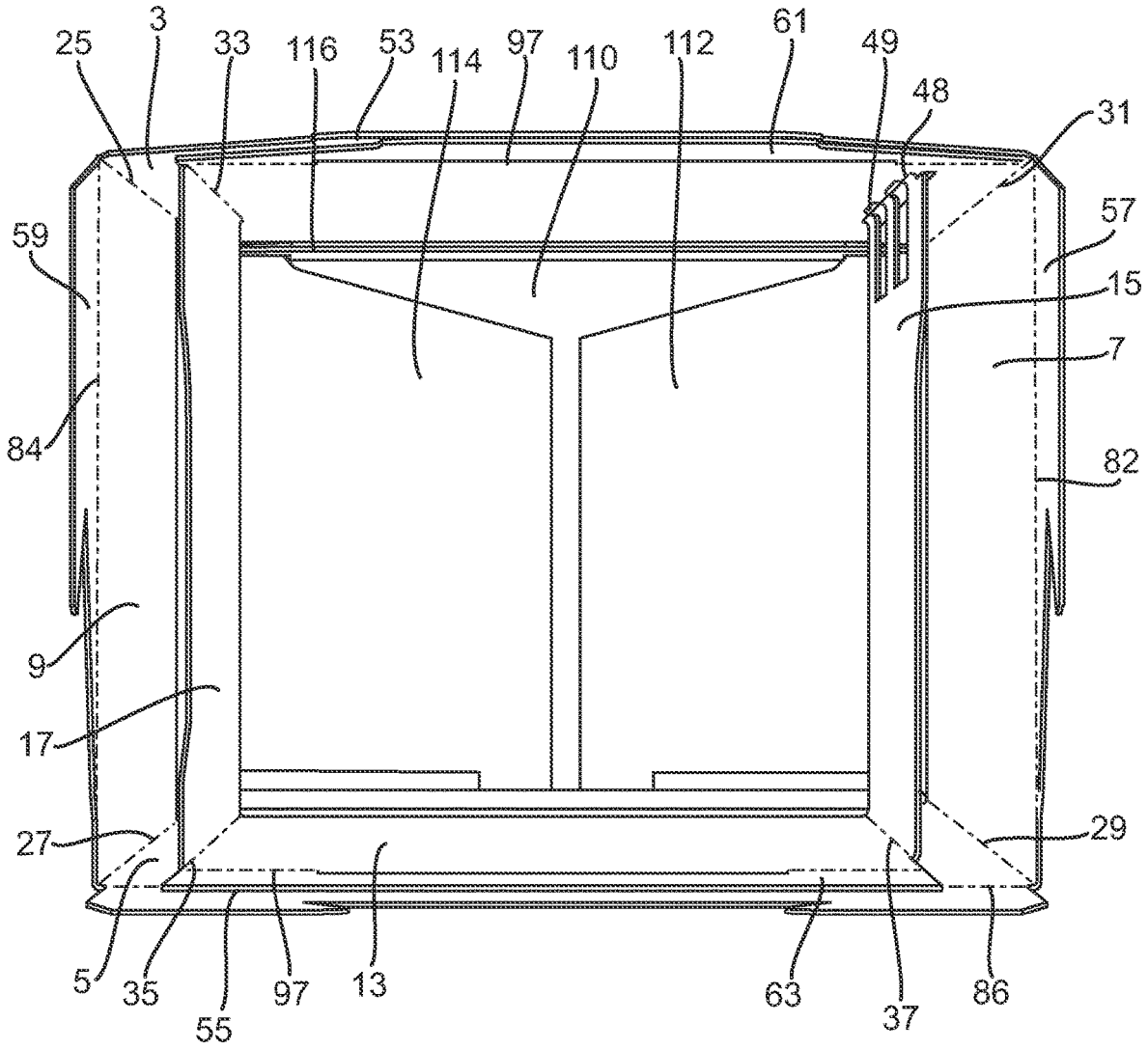
FIG. 4A is a view of the interior of the erected blank of FIG. 2E taken from the second, bottom end prior to closing of the first and second ends of the container.
Figure 4B:
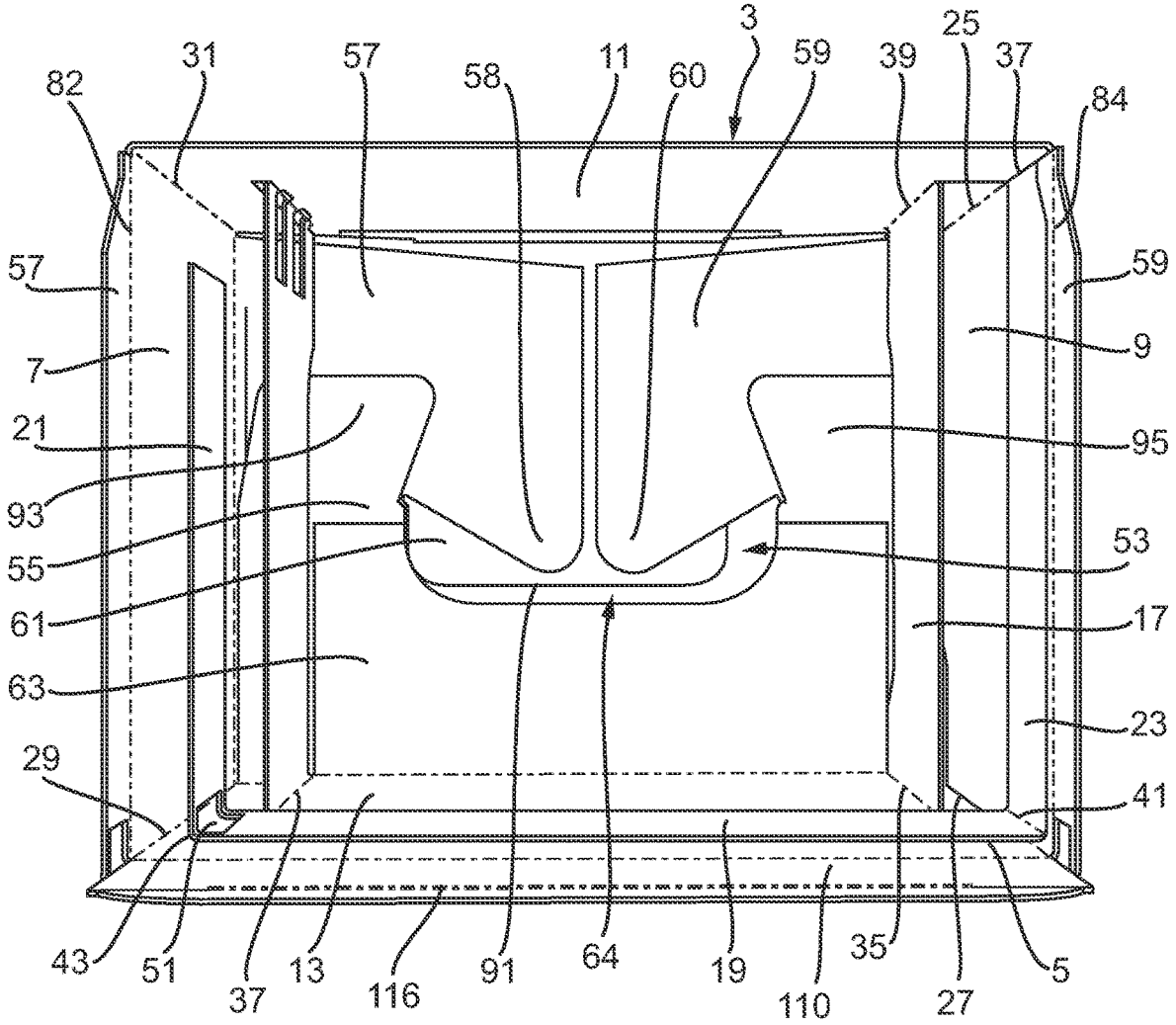
FIG. 4B is a view of the interior of the erected blank of FIG. 2E taken from the first, top end prior to closing of the first and second ends of the container.

Certain features of the erected container 100 will now be described by reference to FIGS. 4A and B. FIG. 4A is a view into the interior of the container through the second end (with the base structure open for the purposes of illustration). FIG. 4B is a view into the interior of the container through the first end (with the lid structure open for the purposes of illustration).

It may be seen that the third inner sidewall panel 15 is parallel to and spaced from the third outer shell sidewall panel 7, and the fourth inner sidewall panel 17 is parallel to and spaced from the fourth outer shell sidewall panel 9. In contrast, the second inner sidewall panel 13 is in face-to-face contact with (and adhered to) the inner surface of the second outer shell sidewall panel 5, and the first inner sidewall panel 11 is in face-to-face contact with (and adhered to) the first outer shell sidewall panel 3. The third and fourth inner sidewall panels 15, 17 reduce the interior space defined between the third and fourth outer shell sidewall panels 7, 9. This may enable the container to more closely support a product e.g. bottle located in the container in the lower part of the container.

As may be seen particularly in FIG. 4B, the fifth inner sidewall panel 19 is in face-to-face contact with (and adhered to) the second outer shell sidewall panel 5, and the seventh inner sidewall panel 23 is in face-to-face contact with (and adhered to) the fourth outer shell sidewall panel 9. Of course, in other embodiments, the seventh inner sidewall panel 23 need not be adhered to the fourth outer shell sidewall panel 9. The sixth inner sidewall panel 21 is in face-to-face contact with (and adhered to) the third outer shell sidewall panel 7. The sixth inner sidewall panel 21 does not extend across the entire width of the third outer shell sidewall panel 7. The first inner sidewall panel 11 is in face contact with, and adhered to the first outer shell sidewall panel 3 over its entire height, and including the region toward the first end of the container where the panels of the second set of further inner sidewall panels 78 are disposed. The portion of the first inner sidewall panel 11 in this region of the container, and the panels of the second set of further inner sidewall panels 78 therefore act to reinforce the upper portion of the container i.e. the portion closer to the first end, providing the sidewalls of the container effectively with a two layer construction. This is achieved in a manner which avoids laminating sheets of material together to provide the blank initially, which may undesirably complicate manufacture and assembly.

FIG. 4B shows the way in which the base flaps and base reinforcement flaps interlock to provide the closed base structure. It may be seen that the distal ends of the fourth base flap 53 and the second base reinforcement flap 61 extend through a slot provided by the distal edge regions of the distal portions of the second and third base flaps 57, 59 and the proximal edge 56 of the recess in the first base flap and of the recess in the distal end of the corresponding underlying first base reinforcement flap 63. The distal ends of the fourth base flap 53 and the underlying second reinforcement flap, which are located within the container, provide locking tab portions (the locking tab portion of the fourth base flap 53 being denoted 64). The bases of these locking tab portions are sandwiched between the hooks 58, 60 associated with the second and third base flaps and the region of the first reinforcement flap 63, proximal to the slot defining edge therein. The distal portions 93, 95 of the first base flap 55 and the underlying first reinforcement flap 63 overlie (and are in face-to-face contact with) the second and third base flaps when the base is viewed from the interior as in FIG. 4B, to help secure the second and third base flaps in place, and hence to help inhibit movement of the distal end of the fourth base flap and the second reinforcement flap out of the slot e.g. when a force is applied by a product located in the container, to urge the base outwardly in use. The first and second reinforcement flaps are in face-to-face contact with their respective base flaps, and are unsecured thereto.

This arrangement provides an envelope type base structure, but in which certain flaps i.e. the first and fourth base flaps, are reinforced. Thus, reinforcement is provided for flaps which are particularly important in avoiding failure of the base.

It is envisaged that a reinforcement flap may only be provided in respect of one of the first and fourth base flaps.

Figure 5:
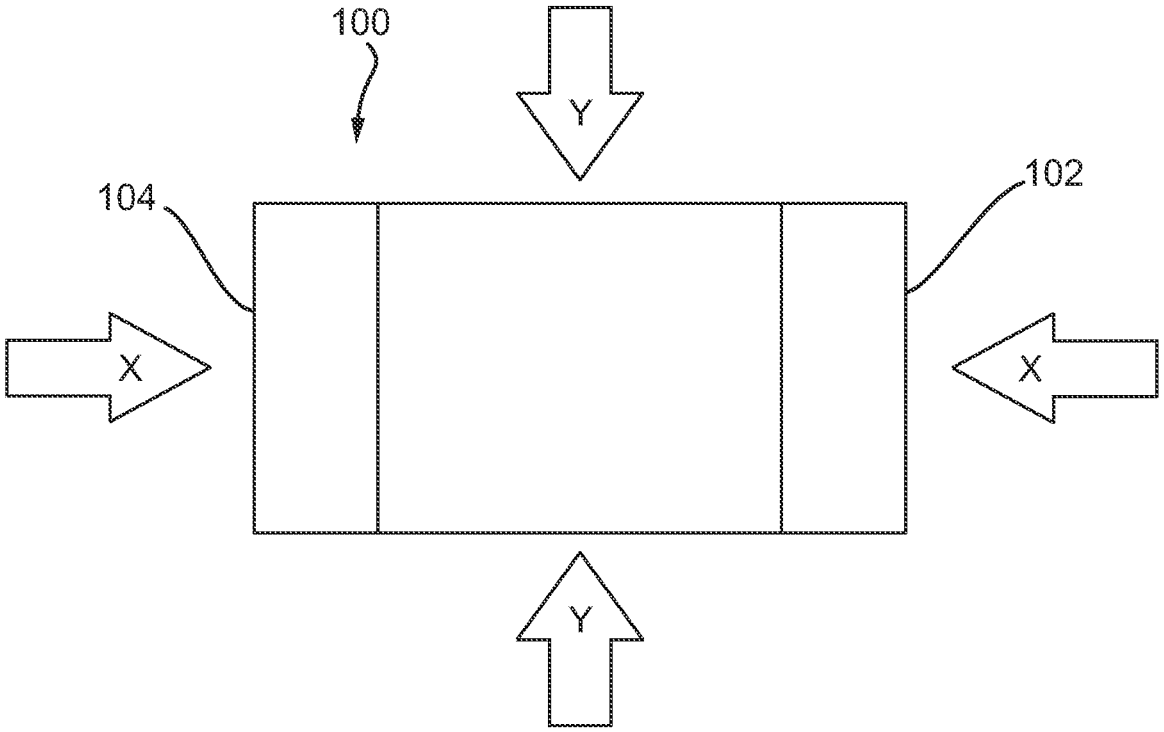
FIG. 5 illustrates certain directions referred to in determining strength of the container using a pinch test.

The container may provide both improved support for a product located therein, and improved strength properties. The spacing between the third and fourth inner sidewall panels and the corresponding outer shell sidewall panels may be adjusted as desired. A greater spacing may result in a larger outer shell, providing a greater shelf presence, while still providing support to the product therein. It has been found that the present invention enables a relatively weaker sheet material to be used, without detrimental effect on base and pinch strength of the container, as a result of the doubling up of certain panels of the sidewalls and base of the container. The term "pinch strength" herein is a function of strength in the x and y dimensions (the x dimension being the direction along the axis of the container between the first and second ends and the y dimension being the direction perpendicular thereto as shown in FIG. 5).

For example, the first set of further inner sidewall panels may cooperate with the first inner sidewall panel to provide support to around the lower ⅔ of the height of a product in the illustrated embodiment. However, the relative position of the cutline 45, and hence the relative heights of the inner sidewall panels of the first and second sets of further inner sidewall panels may be adjusted as desired, depending upon the configuration of a product to be held by the container.

It will be seen that by separating the first and second sets of further inner sidewall panels 76, 78 using a cutline 45, and offsetting the foldlines connecting the panels within each set of further inner sidewall panels, and those connecting the sets of further sidewall panels to the first inner sidewall panel 11, sets of further inner sidewall panels which may be used for the different purposes of reinforcement of the sidewalls of the container toward the first end, or providing an internal fitment to reduce the interior space within the container toward the second end, are obtained. The offsetting of the foldlines 39, 33 and 41, 35 enables the seventh inner sidewall panel 23 to be located in contact with the fourth outer shell sidewall panel 9 while the fourth inner sidewall panel 17 is spaced therefrom. Likewise the offsetting of foldlines 41, 43 and foldlines 43, 37 enables the third inner sidewall panel 15 to be spaced from the interior of the third outer shell sidewall panel 7, while the sixth inner sidewall panel 21 is spaced therefrom.

The Applicant has realised that the portion of the blank used to provide the second set of further inner sidewall panels 78 need not be required to form part of an internal fitment reducing the interior space of the container. This redundant area is instead used to provide reinforcement to the container in the upper region, closer to the first end, improving the strength of the container.

It has also been recognised that the flaps 61 and 63 connected to the ends of the first inner sidewall panel 11 and the second inner sidewall panel 13 may be used to reinforce the outer base flaps 53, 55 associated with the second and first outer shell sidewall panels 9, 3. These flaps may be cut from areas of the sheet from which the blank is produced which would otherwise be wasted.

FIG. 6 illustrates a blank 200 which may be erected to provide a container in accordance with a further embodiment of the invention from the surface which will form exterior surfaces in the erected container. The blank is of the same general configuration as that shown in FIG. 1, but illustrating certain modifications which may be made within the scope of the invention. The parts which differ from the embodiment of FIG. 1 are annotated with corresponding reference numerals incremented by 200. The slot 51 along foldline 43 has been removed, such that the fifth and sixth inner sidewall panels 219, 221 are connected by a foldline 243 of the same type as those connecting the other panels of the further sets of inner sidewall panels. The side panels 229, 214 of the lid panel array 270 are of a different configuration. The second and third base flaps 257, 259 are of a different shape, with the distal portions defining flatter hooks. Of course, these are merely exemplary of some of the many possible shapes which may be used.

While those ones of the inner and outer sidewall panels which are in facing relationship have been described as being in face-to-face contact, it is envisaged that at least some of the pairs of facing panels need not necessarily be in face-to-face contact, provided that the sixth and seventh inner sidewall panels are closer to the third and fourth outer shell sidewall panels than are the third and fourth inner sidewall panels.

While the bonding of various components to one another has been described in relation to an adhesive connection, other bonding technologies may be used e.g. heat sealing etc. An adhesive connection referred to herein may, unless the context demands otherwise, in general be any bonded connection, not limited to adhesive.

It is envisaged that the number of inner and outer shell sidewall panels may vary from that illustrated.

All of the assembly steps described by reference to FIGS. 2A-E and 3A-C, including all gluing and folding steps, may be performed in a fully automated manner by a machine.

The containers described herein may be used with any desired product, but are particularly useful in the context of fragile products, such as bottles e.g. drinks bottles. The construction may provide a relatively stronger container for such products, in embodiments, with reduced risk of base failure.

It will be understood that the above description is of a number of exemplary embodiments only and that modifications may be made to the embodiments without departing from the scope of the invention.

The invention claimed is:

1. A single piece container made from cardboard, paperboard or other lightweight foldable sheet material, the container comprising:

an outer shell having a first end and a second end, and comprising a plurality of sidewall panels hingedly connected to one other about respective outer shell sidewall foldlines, the sidewall panels extending between the first end and the second end of the outer shell, the sidewall panels comprising first, second, third and fourth outer shell sidewall panels, wherein the first and second outer shell sidewall panels and the third and fourth outer shell sidewall panels form respective opposed pairs of outer shell sidewall panels, and wherein at least the second end of the outer shell is a closed end;

a first inner sidewall panel in facing relationship with the inner surface of the first outer shell sidewall panel, the first inner sidewall panel being integrally connected to one of the outer shell sidewall panels along a foldline;

and a first set of further inner sidewall panels integrally connected to the first inner sidewall panel along a foldline, the sidewall panels of the set of further inner sidewall panels being hingedly connected to one another about respective foldlines;

the first set of further inner sidewall panels comprising;

a second inner sidewall panel in facing relationship with the inner surface of the second outer shell sidewall panel, and third and fourth opposed inner sidewall panels extending between the first and second inner sidewall panels, the third inner sidewall panel being located on the same side of the container as the third outer shell sidewall panel and being located inwardly of and spaced from the inner surface of the third outer shell sidewall panel, and the fourth inner sidewall panel being located on the same side of the container as the fourth outer shell sidewall panel and being located inwardly of and spaced from the inner surface of the fourth outer shell sidewall panel;

the container further comprising a second set of further inner sidewall panels integrally connected to the first inner sidewall panel along a foldline, the sidewall panels of the second set of further inner sidewall panels being hingedly connected to one another about respective foldlines, the second set of further inner sidewall panels being located between the first set of further inner sidewall panels and one of the ends of the container, the second set of further inner sidewall panels comprising;

a fifth inner sidewall panel in facing relationship with the inner surface of the second outer shell sidewall panel, a sixth inner sidewall panel in facing relationship with the inner surface of the third outer shell sidewall panel, wherein the sixth inner sidewall panel is located closer to the third outer shell sidewall panel than the third inner shell sidewall panel, and a seventh inner sidewall panel in facing relationship with the inner surface of the fourth outer shell sidewall panel, wherein the seventh inner sidewall panel is located closer to the fourth outer shell sidewall panel than the fourth inner sidewall panel.

2. The container of claim 1 wherein the first and second inner sidewall panels are located in face-to-face contact with the inner surfaces of the first and second outer shell sidewall panels respectively.

3. The container of claim 1 wherein the fifth, sixth and seventh inner sidewall panels are located in face-to-face contact with the inner surfaces of the second, third and fourth outer shell sidewall panels respectively.

4. The container of claim 1 wherein the second set of further inner sidewall panels is located between the first set of further inner sidewall panels and the first end of the container.

5. The container of claim 1 wherein each one of the panels of the first set of further inner sidewall panels has a height that is greater than each one of the sidewall panels of the second set of further inner sidewall panels.

6. The container of claim 1 wherein the first and second sets of further inner sidewall panels are located directly adjacent one another along the direction extending between the first and second ends of the outer shell.

7. The container of claim 1 wherein edges of the second inner sidewall panel and the fifth inner sidewall panel abut one another.

8. The container of claim 1 wherein edges of the fourth and seventh, and third and sixth inner sidewall panels respectively are located directly adjacent one another along the direction extending between the first and second ends of the outer shell, with the edge of the fourth inner sidewall panel being located inboard of the edge of the seventh inner sidewall panel, and the edge of the third inner sidewall panel being located inboard of the edge of the sixth inner sidewall panel.

9. The container of claim 1 wherein the container is erected from a single piece blank in which adjacent ends of the panels of the first and second sets of further inner sidewall panels are separated by a cutline.

10. The container of claim 1 wherein the fourth and seventh inner sidewall panels are connected along respective foldlines to the first inner sidewall panel respectively.

11. The container of claim 1 wherein the first inner sidewall panel is integrally connected to the third outer shell sidewall panel along a foldline.

12. The container of claim 1 wherein the foldline connecting the first set of further inner sidewall panels to the first inner sidewall panel is offset from the foldline connecting the second set of further inner sidewall panels to the first inner sidewall panel.

13. The container of claim 1 wherein the third inner sidewall panel is attached to the first inner sidewall panel using one or more glue tabs, wherein each glue tab is released from the third inner sidewall panel.

14. The container of claim 13 wherein the third inner sidewall panel is connected to the second inner sidewall panel along a foldline along one edge of the third inner sidewall panel, and a flap is connected to an opposite edge of the third inner sidewall panel, wherein the or each tab has a base which extends from a proximal edge of the flap, optionally wherein the flap extends toward a foldline connecting the first inner shell sidewall panel to the second outer shell sidewall panel.

15. The container of claim 1 wherein one or more of the outer shell sidewall panels comprises a base flap connected to a second end thereof for use in providing a closed base at the second end of the outer shell, and wherein one or more of the first inner sidewall panel and first set of further inner sidewall panels comprises a reinforcement flap connected to a second end thereof along a foldline, which reinforcement flap is arranged underlie one of the base flaps of the outer shell to reinforce the outer shell base flap.

16. The container of claim 15 wherein each one of the first, second, third and fourth outer shell sidewall panels comprises a base flap connected to the second end thereof along a foldline to provide a set of base flaps, the base flaps including;

a first base flap connected along a foldline to one of the sidewalls;

second and third opposed base flaps connected along respective foldlines to respective ones of the sidewalls adjacent the sidewall to which the first base flap is connected on either side thereof, and wherein the second and third base flaps are folded over the first base flap;

and a fourth base flap connected along a foldline to a sidewall opposite the sidewall to which the first base flap is connected, wherein the fourth base flap is folded over the second and third base flaps;

wherein the fourth base flap comprises a base panel portion which forms part of the exterior of the base and a locking tab portion connected to a distal end of the base panel portion, wherein the locking tab portion of the fourth base flap is inserted through a slot defined by the first, second and third base flaps into the interior of the container to retain the base in a closed configuration;

wherein a reinforcement flap is provided in respect of at least the first and fourth base flaps.

17. The container of claim 15 wherein each reinforcement flap extends over only a portion of the area of the outer shell base flap which it reinforces.

18. The container of claim 15, wherein the reinforcement flap is unsecured to its outer shell base flap.

19. A single piece blank erectable to provide a container in accordance with claim 1.

20. The blank of claim 19 wherein the blank comprises;

a first subset of panels connected to one another along respective foldlines for providing the sidewalls of the outer shell;

a first inner sidewall panel connected on one side along a foldline to one of the first subset of panels for providing the first inner sidewall panel of the container;

a second subset of panels connected to one another along respective foldlines for providing the first further set of inner sidewall panels, wherein one of the second subset of panels is connected to the first inner sidewall panel along the other side thereof along a foldline;

and a third subset of panels connected to one another along respective foldlines for providing the second further set of inner sidewall panels, wherein one of the third subset of panels is connected to the first inner sidewall panel along said other side thereof along a foldline;

wherein the foldline connecting said one of the second subset of panels to the first inner sidewall panel is offset from the foldline connecting said one of the third subset of panels to the first inner sidewall panel;

and wherein adjacent edges of the second and third subsets of panels are separated from one another by a cutline.

* * * * *